US011109166B2

(12) United States Patent
Jensen et al.

(10) Patent No.: US 11,109,166 B2
(45) Date of Patent: Aug. 31, 2021

(54) HEARING DEVICE COMPRISING DIRECT SOUND COMPENSATION

(71) Applicant: Oticon A/S, Smørum (DK)

(72) Inventors: Jesper Jensen, Smørum (DK); Peter Sommer, Smørum (DK); Svend Oscar Petersen, Smørum (DK); Karsten Bo Rasmussen, Smørum (DK); Jan M. De Haan, Smørum (DK); Michael Syskind Pedersen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/737,624

(22) Filed: Jan. 8, 2020

(65) Prior Publication Data

US 2020/0221236 A1 Jul. 9, 2020

(30) Foreign Application Priority Data

Jan. 9, 2019 (EP) ..... 19150885

(51) Int. Cl.
*H04R 25/00* (2006.01)

(52) U.S. Cl.
CPC ..... *H04R 25/505* (2013.01); *H04R 25/554* (2013.01); *H04R 2225/43* (2013.01); *H04R 2460/01* (2013.01)

(58) Field of Classification Search
None
See application file for complete search history.

(56) References Cited

U.S. PATENT DOCUMENTS 5,852,667 A * 12/1998 Pan ..... G10K 11/17881 381/71.1
2009/0041260 A1 2/2009 Jorgensen et al.
(Continued)

FOREIGN PATENT DOCUMENTS

WO WO 2018/141557 A1 8/2018

*Primary Examiner* — Paul W Huber
(74) *Attorney, Agent, or Firm* — Birch, Stewart, Kolasch & Birch, LLP.

(57) ABSTRACT

A hearing device, e.g. a hearing aid, configured to play sound into an ear canal of a user, the hearing device comprising at least one input transducer ($IT_q$) for picking up sound $s_q$ at said at least one input transducer from a sound field S around the hearing device and providing corresponding at least one electric input signal(s) $IN_q$ representing said sound $s_q$, i=1, . . . , Q, where Q≥1;

an analogue to digital converter for converting said at least one electric input signal(s) to a digitized signal represented by discrete samples $s_q(p)$, where p is a time sample index, a processor for processing said at least one electric input signal $s_q(p)$ to a processed signal;

an output transducer (OT) for converting an electric signal including said processed signal to an acoustic signal s";

a forward signal path of the hearing device being defined from an acoustic input to said at least one input transducer to an acoustic output of said output transducer having a forward signal propagation delay $\tau_{HI}$ of the hearing device, the hearing device further comprises a compensation unit for at least partially cancelling directly propagated sound from said sound field S that is propagated to the ear canal via a direct acoustic propagation path, wherein the compensation unit is configured to predict said directly propagated sound (Continued)

and to play it in opposite phase of said directly propagated sound. A method of operating a hearing device is further disclosed.

21 Claims, 12 Drawing Sheets

(56) References Cited

U.S. PATENT DOCUMENTS

| | | | |
|---|---|---|---|
| 2010/0232622 | A1 | 9/2010 | Kasanmascheff et al. |
| 2015/0003624 | A1 | 1/2015 | Sato |
| 2018/0376258 | A1 | 12/2018 | Tiefenau et al. |

* cited by examiner

HEARING DEVICE COMPRISING DIRECT SOUND COMPENSATION

SUMMARY

The present application relates to the field of hearing devices, e.g. hearing aids or ear phones or headsets.

A Hearing Device

In an aspect of the present application, a hearing device, e.g. a hearing aid, configured to play sound into an ear canal of a user is provided. The hearing device comprises

- at least one input transducer ($IT_q$) for picking up sound $s_q$ at said at least one input transducer from a sound field S around the hearing device and providing corresponding at least one electric input signal(s) $IN_q$ representing said sound $s_q$, i=1, . . . , Q, where Q≥1;
- an analogue to digital converter for converting said at least one electric input signal(s) to a digitized signal represented by discrete samples $s_q(p)$, where p is a time sample index,
- a processor for processing said at least one electric input signal $s_q(p)$ to a processed signal;
- an output transducer (OT) for converting an electric signal including said processed signal to an acoustic signal s".

A forward signal path of the hearing device is defined from an acoustic input to said at least one input transducer to an acoustic output of said output transducer having a forward signal propagation delay $\tau_{HI}$ of the hearing device is provided. The hearing device further comprises a compensation unit for at least partially cancelling directly propagated sound from said sound field S that is propagated to the ear canal via a direct acoustic propagation path. The compensation unit is configured to predict said directly propagated sound and to play it in opposite phase of said directly propagated sound.

Thereby an improved hearing device may be provided.

The term 'opposite phase' is intended to indicate a 180° difference in phase between the two signals (to thereby allow a mutual cancellation of the two signals). The direct acoustic propagation path from the acoustic input to said at least one input transducer to the acoustic output of said output transducer shows a direct propagation delay $\tau_{dir}$. The direct propagation delay $\tau_{dir}$ is typically smaller (e.g. more than 5-10 times smaller) than the forward signal propagation delay $\tau_{HI}$ of the hearing device, such as much smaller (e.g. more than 100-1000 times smaller) than $\tau_{HI}$. The number Q of input transducers, e.g. microphones, may e.g. be 2 or 3 or 4 or more.

The compensation unit may be configured to predict the discrete samples $s_q(p)$ in dependence of a delay $\tau_{comp}$ of the compensation unit. The compensation unit may be configured to predict the discrete samples $s_q(p)$ in dependence of a delay $\tau_{dir}$ of the direct acoustic propagation path. The compensation unit may be configured to predict the discrete samples $s_q(p)$ in dependence of a delay $\tau_{comp}$ of the compensation unit and of a delay $\tau_{dir}$ of the direct acoustic propagation path. The delay $\tau_{comp}$ of the compensation unit may be larger than the delay $\tau_{dir}$ of the direct acoustic propagation path. The compensation unit may be configured to predict the discrete samples $s_q(p)$, which are $\tau_{pred}=\tau_{comp}-\tau_{dir}$ [seconds] in the future. The delay $\tau_{dir}$ of the direct acoustic propagation path may be frequency dependent. The delay $\tau_{comp}$ of the compensation unit may be frequency dependent.

When the compensation unit is integrated in the hearing device, the delay $\tau_{comp}$ of the compensation unit may comprise the delay of the electric signal path from the input of the at least one input transducer to the output of the output transducer.

The delay $\tau_{comp}$ of the compensation unit (CU) may be taken to mean the delay of the electric signal path from the input of an input transducer (e.g. $M_2$ in FIG. 4A) picking up sound to the output of an output transducer (e.g. SPK in FIG. 4A) delivering the 'compensation signal' predicted by the compensation unit (CU, cf. dashed enclosure in FIG. 4A, exhibiting a delay $\tau_{comp}=\tau_I+\tau_{eCU}+\tau_O$, where $\tau_I$, $\tau_{eCU}$, and $\tau_O$ are the delays of the input stage (comprising units M1, AD), the processing part eCU of the compensation unit, and the output stage (comprising units '+', DA, OU), respectively in FIG. 5).

The hearing device may be configured to include frequency-shaping of a transfer function representing said direct acoustic propagation path. The frequency-shaping may e.g. comprise application of a frequency dependent gain (e.g. amplification or attenuation, and/or phase change) to the prediction of said directly propagated sound. The shaping may be represented by an impulse response or a frequency transfer function (indicated by $h_{ec}$ in FIG. 3A) of the direct acoustic propagation path. The delay $\tau_{dir}$ of the direct acoustic propagation path may be frequency dependent.

The compensation unit may be configured to predict the directly propagated sound based on a linear or non-linear prediction algorithm or a combination of a linear and a non-linear prediction algorithm. The compensation unit may be configured to predict future samples of the electric input signal (or a processed version thereof) based on current and past samples.

The compensation unit may be configured to predict the directly propagated sound based on linear or non-linear minimum mean square error (MMSE) prediction.

The compensation unit may be configured to predict the directly propagated sound based on a linear combination of a current and a number P−1 of past samples of the electric input signal, or a processed version thereof, using corresponding weights $a_i$, i=0, 1, . . . , P−1 or using a non-linear function f(.). The directly propagated sound may e.g. be predicted based on a neural network. The neural network may e.g. be trained in an on-line or off-line procedure using data from a variety of acoustic environments, e.g. environments appropriate for a specific user.

The hearing device may comprise a memory wherein parameters of relevance for the prediction of the directly propagated sound can be permanently and/or temporarily stored and accessed by the processor and/or by the compensation unit. Parameters of relevance to prediction include the number of historic samples (P, K) to be considered by the prediction algorithm. The parameters (P, K) should be chosen long enough (K being at least ≥P) to catch the periodicity of the current sound, but not so long that it includes sound (e.g. speech) that is not relevant for the prediction of the present sound (e.g. speech) elements (e.g. representing another sentence or word (or even another speaker)). Further, parameters (P, K) should be chosen as small as possible with a view to (limiting) computational complexity (to limit power consumption).

The compensation unit may be configured to determine the weights $a_i$, i=0, 1, . . . , P−1 or the non-linear function f(.) in an off-line procedure. The weights or the non-linear function f(.) (or an approximation thereof) may be stored in the memory prior to use of the hearing device, e.g. during fitting or manufacturing of the hearing device.

The compensation unit may be configured to determine the weights $a_i$, i=0, 1, . . . , P−1 or the non-linear function f(.) during use of the hearing device.

The compensation unit is configured to determine said weights $a_i$, i=0, 1, . . . , P−1 or said non-linear function f(.) using an optimization procedure involving a cost function. The compensation unit may be configured to determine the weights $a_i$, i=0, 1, . . . , P−1 or the non-linear function f(.) by minimizing a least square prediction error (MMSE). The prediction error may be determined from (preferably recent) historic data of the electric input signal for which a predicted value ŝ and a known value s of the directly propagated sound at said number of past samples of the electric input signal, or a processed version thereof, are known, and possibly stored in a memory of the hearing device (or accessible to the hearing device). The prediction error may be minimized (only) in a selected frequency range (e.g. where speech is known to be present or important for speech intelligibility, see e.g. FIG. 7B) by minimizing a frequency-weighted prediction error.

The weights $a_i$, i=0, 1, . . . , P−1 or said non-linear function f(.) are updated during use of the hearing device. The weights or the non-linear function may e.g. be continuously updated, e.g. for every sample or for every $N^{th}$ sample. The weights or the non-linear function may e.g. be updated based on a control signal from on an acoustic environment detector, e.g. when a change in acoustic environment is detected. The update process may e.g. be initiated based on a user input, e.g. via a user interface, e.g. implemented as an APP of a smartphone, e.g. a voice controlled interface, cf. e.g. FIG. 6B.

The hearing device may comprise a time to time-frequency conversion unit for providing a time-domain input signal in a frequency sub-band representation. The hearing device, e.g. the compensation unit, may be configured to execute the prediction algorithm in all frequency bands k=1, . . . , K, e.g. using a different number $P_k$ of historic values to predict the future value in at least some of the K frequency bands.

The compensation unit may be configured to minimize a prediction error, which is weighted as a function of time and/or frequency. The prediction of the directly propagated sound may be based on a cost function related to a user's perception, e.g. using a perceptual model. The compensation unit may be configured to determine the prediction of the directly propagated sound that leads to the least perceptually objectionable signal. This may be achieved by minimizing a prediction error, which is weighted as a function of time and frequency (e.g. represented by a function g(l,n), where l is a frequency index and n is the time index, cf. e.g. function G(f) in FIG. 8A, 8B.

The hearing device may be configured to execute the prediction algorithm only in selected frequency bands, e.g. frequency bands having the most importance for speech intelligibility, e.g. frequency bands above a low-frequency threshold frequency $f_{th,low}$ and below a high-frequency threshold frequency $f_{th,high}$. The high frequency threshold frequency $f_{th,high}$ may e.g. be 4 kHz, or 3 kHz, or 2 kHz or smaller, e.g. 1 kHz. The low-frequency threshold frequency $f_{th,low}$ may e.g. be larger than or equal to 100 Hz or 200 Hz, or larger than or equal to 500 Hz (e.g. to take account of the fact that low frequency sound tend to escape through the vent or dome openings (and thus do not disturb the signal at the eardrum significantly)).

The hearing device may comprise an onset detector for identifying transients in the electric input signal and to provide an onset control signal in dependence thereof, wherein the compensation unit is configured to limit or override the currently predicted value of said directly propagated sound whenever the onset control signal indicates that a transient has been detected. In case of a detection of a transient (e.g. defined by a level increase per time unit above a threshold value) at a given point in time, e.g. at time index n, the currently predicted value of the directly propagated sound may be overridden (ignored, e.g. overwritten). Instead a previously predicted value of the directly propagated sound may be used as the current prediction.

The hearing device may comprise at least two input transducers providing corresponding at least two electric input signals and a beamformer filtering unit for providing a spatially filtered signal based on said at least two electric input signals. The hearing device may comprise three or more or four or more input transducers (or be configured to receive corresponding one or two or more electric input signals (or parts thereof, e.g. selected frequency ranges)). The processed signal of the forward path intended for being presented to the user may be based on the spatially filtered signal.

The hearing device may be constituted by or comprise a hearing aid, or any other wearable earpiece, e.g. a headset, an earphone, a headphone, an ear protection device or a combination thereof.

The hearing device may be adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device may comprise an output unit for providing a stimulus perceived by the user as an acoustic signal based on a processed electric signal. In an embodiment, the output unit comprises a number of electrodes of a cochlear implant (for a CI type hearing device) or a vibrator of a bone conducting hearing device. In an embodiment, the output unit comprises an output transducer. In an embodiment, the output transducer comprises a receiver (loudspeaker) for providing the stimulus as an acoustic signal to the user (e.g. in an acoustic (air conduction based) hearing device). In an embodiment, the output transducer comprises a vibrator for providing the stimulus as mechanical vibration of a skull bone to the user (e.g. in a bone-attached or bone-anchored hearing device).

The hearing device may comprise an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device may comprise a directional microphone system adapted to spatially filter sounds from the environment, and thereby enhance perception of a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in the literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing device may comprise an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device, e.g. a hearing aid. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme. In an embodiment, the wireless link is based on a standardized or proprietary technology. In an embodiment, the wireless link is based on Bluetooth technology (e.g. Bluetooth Low-Energy technology).

The hearing device may be a portable device, e.g. a device comprising a local energy source, e.g. a battery, e.g. a rechargeable battery.

The hearing device may comprise a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$, (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

The hearing device may comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

The hearing device, e.g. the microphone unit, and or the transceiver unit may comprise a TF-conversion unit (e.g. an analysis filter bank) for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-) frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

The hearing device may comprise a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

One or more of the number of detectors may operate on the full band signal (time domain). In an embodiment, one or more of the number of detectors operate(s) on band split signals ((time-) frequency domain), e.g. in a limited number of frequency bands.

The number of detectors may comprise a level detector for estimating a current level of a signal of the forward path. In an embodiment, the predefined criterion comprises whether the current level of a signal of the forward path is above or below a given (L-) threshold value. In an embodiment, the level detector operates on the full band signal (time domain) In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

The hearing device may comprise an own voice detector for estimating whether or not (or with what probability) a given input sound (e.g. a voice, e.g. speech) originates from the voice of the user of the device or system. The own voice detector may be configured to provide an own voice control signal indicative of whether or not (or with what probability) a given input sound to the hearing device originates from the voice of the user of the device or system. In an embodiment, the hearing device or system, e.g. a microphone system of the hearing device or system, is adapted to be able to differentiate between a user's own voice and another person's voice and possibly NON-voice sounds. The hearing device or system (e.g. the compensation unit) may be configured to control parameters of the prediction algorithm (e.g. delays and/or frequency shaping) in dependence on detected own voice, such that the hearing device or system (e.g. the compensation unit) copes differently with external sounds compared to sound from the user's mouth (own voice'). The hearing device or system may e.g. be configured to provide more or less aggressive cancellation of the direct propagated sound in dependence of the own voice control signal).

The number of detectors may comprise a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

The hearing device may comprise a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

The hearing device may comprise an acoustic (and/or mechanical) feedback suppression system. In an embodiment, the feedback suppression system comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing device).

The hearing device may further comprise other relevant functionality for the application in question, e.g. compression, noise reduction, etc.

The hearing device may comprise or consist of a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing assistance system comprises a speakerphone (comprising a number of input transducers and a number of output transducers, e.g. for use in an audio conference situation), e.g. comprising a beamformer filtering unit, e.g. providing multiple beamforming capabilities.

Use

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

A Method

In an aspect, a method of operating a hearing device, e.g. a hearing aid, comprising an ITE-part adapted for being located in or at an ear canal of a user and configured to pick up sound from a sound field around the user and to play processed sound into said ear canal is provided. The hearing device has a propagation delay $\tau_{HI}$ defined by the processing delay for processing said sound in a forward signal path from an acoustic input to an acoustic or vibrational output of the hearing device. The method comprises providing at least one electric input signal representing said sound as a digitized signal represented by discrete samples, processing said at least one electric input signal to provide a processed signal;

converting an electric signal including said processed signal to an acoustic signal or mechanical vibration is furthermore provided by the present application.

The method further comprises at least partially compensating for directly propagated sound from said sound field that is propagated to the ear canal via a direct acoustic propagation path by predicting said directly propagated sound, and playing said predicted sound in opposite phase with said directly propagated sound.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program

A computer program (product) comprising instructions which, when the program is executed by a computer, cause the computer to carry out (steps of) the method described above, in the 'detailed description of embodiments' and in the claims is furthermore provided by the present application.

A Data Processing System

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system. The hearing device or system may be configured to allow an active noise suppression mode of operation to be selected and/or configured from the user interface/APP. Parameters of the prediction algorithm may be configured via the user interface/APP.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as applications.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids or ear phones.

Figure 1A:
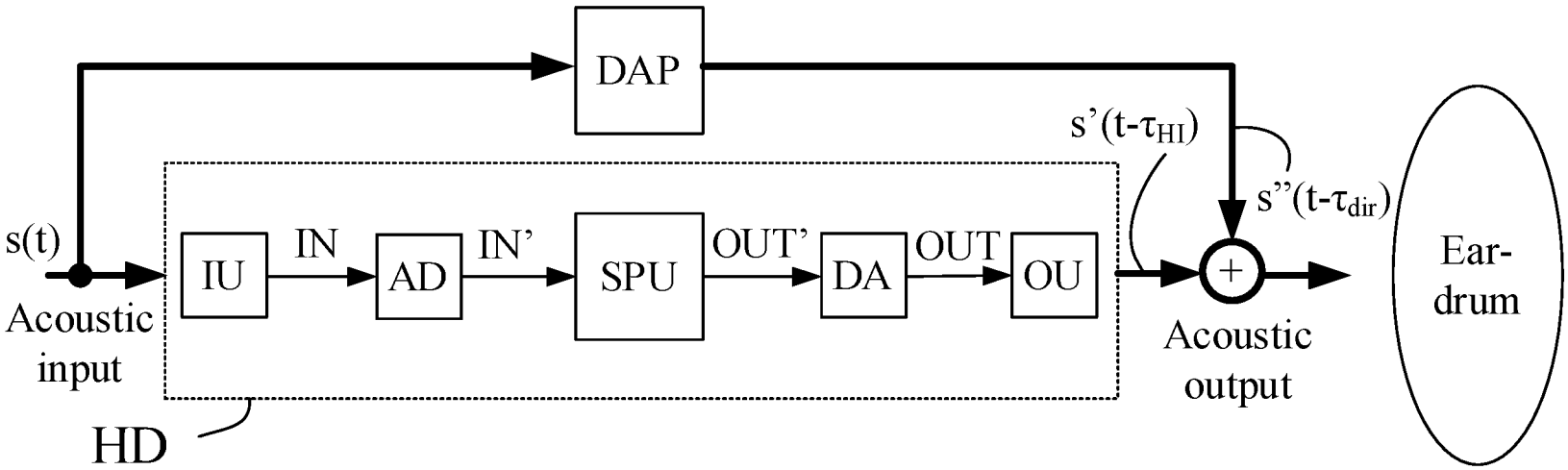
FIG. 1A illustrates a scenario of sound provided by a hearing device being distorted by direct sound leaking through or around the hearing device to the eardrum of a user.

FIG. 1A illustrates a scenario of sound provided by a hearing device being distorted by direct sound leaking through or around the hearing device to the eardrum of a user. The hearing device (HD), e.g. a hearing aid, comprises a forward path comprising an input unit (IU) (e.g. comprising one or more input transducers, e.g. microphones) for picking up sound (s(t), Acoustic input) from the environment of the hearing device and converting it to an electric signal IN representing the sound (or to a number of electric input signals representing sound, if more than one input transducer is present). The hearing device (HD) further comprises an analogue to digital converter (AD) for sampling the (analogue) electric input signal(s) and providing a digitized electric input signal IN', which is fed to a signal processor (SPU) for applying one or more signal processing algorithms to the electric input signal IN' and providing a processed output signal OUT'. The hearing device (HD) further comprises digital to analogue converter (DA) for converting the (digital electric) output signal to an (analogue) electric output signal (OUT), which is fed to an output unit (OU), e.g. an output transducer, e.g. a loudspeaker, for presentation to an eardrum (Eardrum) of the user as an acoustic signal (sound, $s'(t-\tau_{HI})$, Acoustic output). The hearing device may comprise appropriate conversion units (e.g. filter banks) to allow processing of the electric input signal(s) fully or partially in the frequency domain. In addition to the (electric) forward path of the hearing device, a direct acoustic path of sound from the input of the hearing device to the eardrum of the user is indicated in FIG. 1A by a bold arrow (denoted DAP) (and by a curved arrow in FIG. 1B) and signal $s'(t-\tau_{dir})$, which is added to (mixed with) the sound $s'(t-\tau_{HI})$ delivered by the hearing device (as indicated by bold combination unit '+'). The different super scripts ' and " on sound signals s are intended to indicate that the sound signals in question are different because they refer to values of the impinging sound signal s(t) at different points in time ($t-\tau_{dir}$, and $t-\tau_{HI}$, respectively), as further dealt with in the following.

Figure 1B:
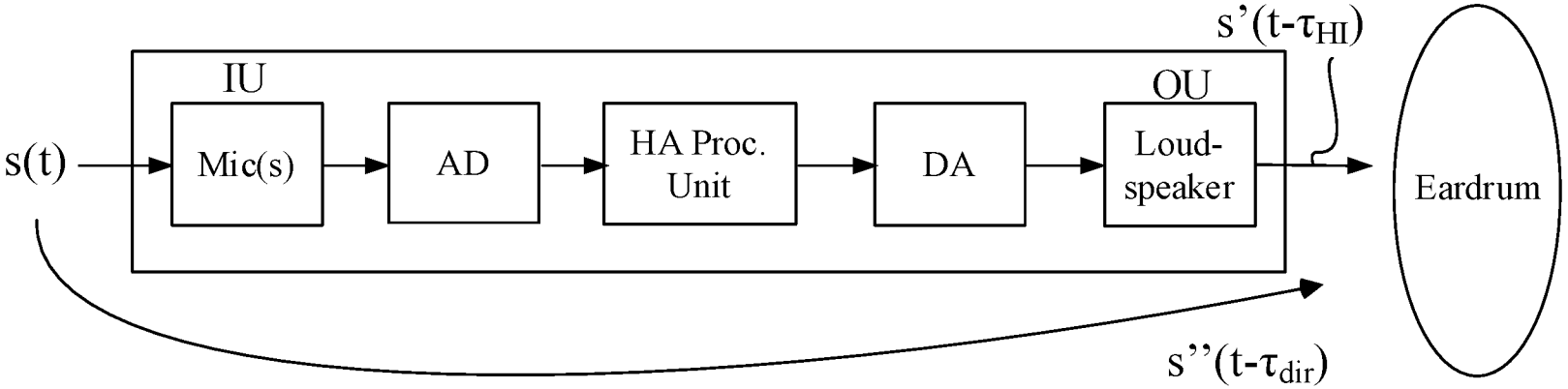
FIG. 1B illustrates the same scenario as in FIG. 1A, but where the input and output units are embodied in one or more microphones and a loudspeaker, respectively, and the processor is a hearing aid processor, FIG. 2 schematically illustrates a compensation of the interfering sound $s''(t-\tau_{dir})$ of the scenario of FIG. 1A, 1B.

FIG. 1B illustrates the same scenario as in FIG. 1A, but where the input and output units (IU, OU) are embodied in one or more microphones (Mic(s)) and a loudspeaker (Loudspeaker), respectively, and the processor is a hearing aid processor (HA Proc. Unit). The hearing device (HD) of FIG. 1B represents a hearing aid, where the hearing aid processor is configured to compensate for a user's hearing impairment (including to apply a frequency and level dependent gain (amplification/attenuation) to an electric input signal representing sound and to present the processed signal via a loudspeaker as an acoustic signal).

Figure 4A:
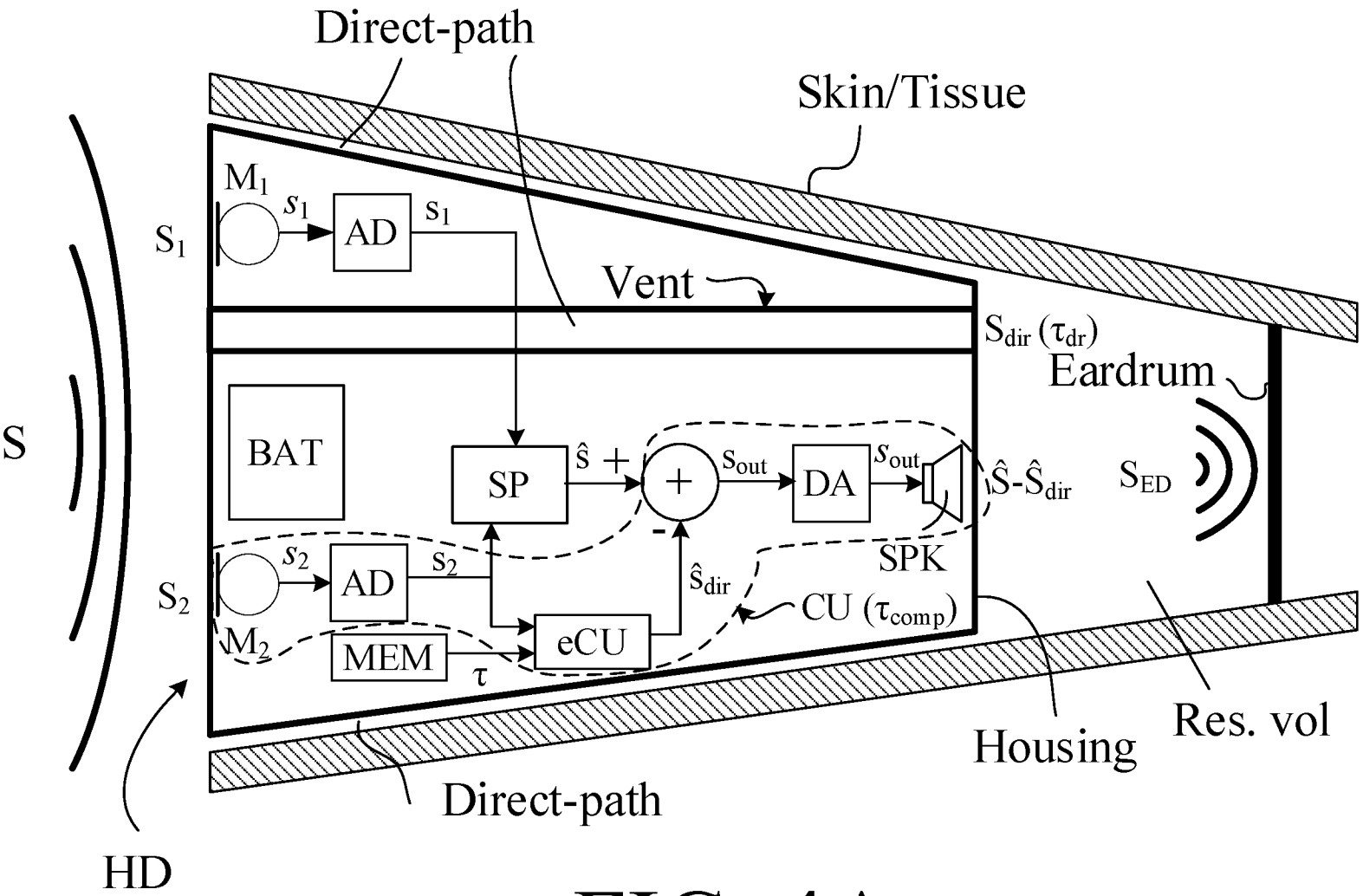
FIG. 4B schematically shows a BTE/RITE style hearing device according to an embodiment of the present disclosure.
Figure 4B:
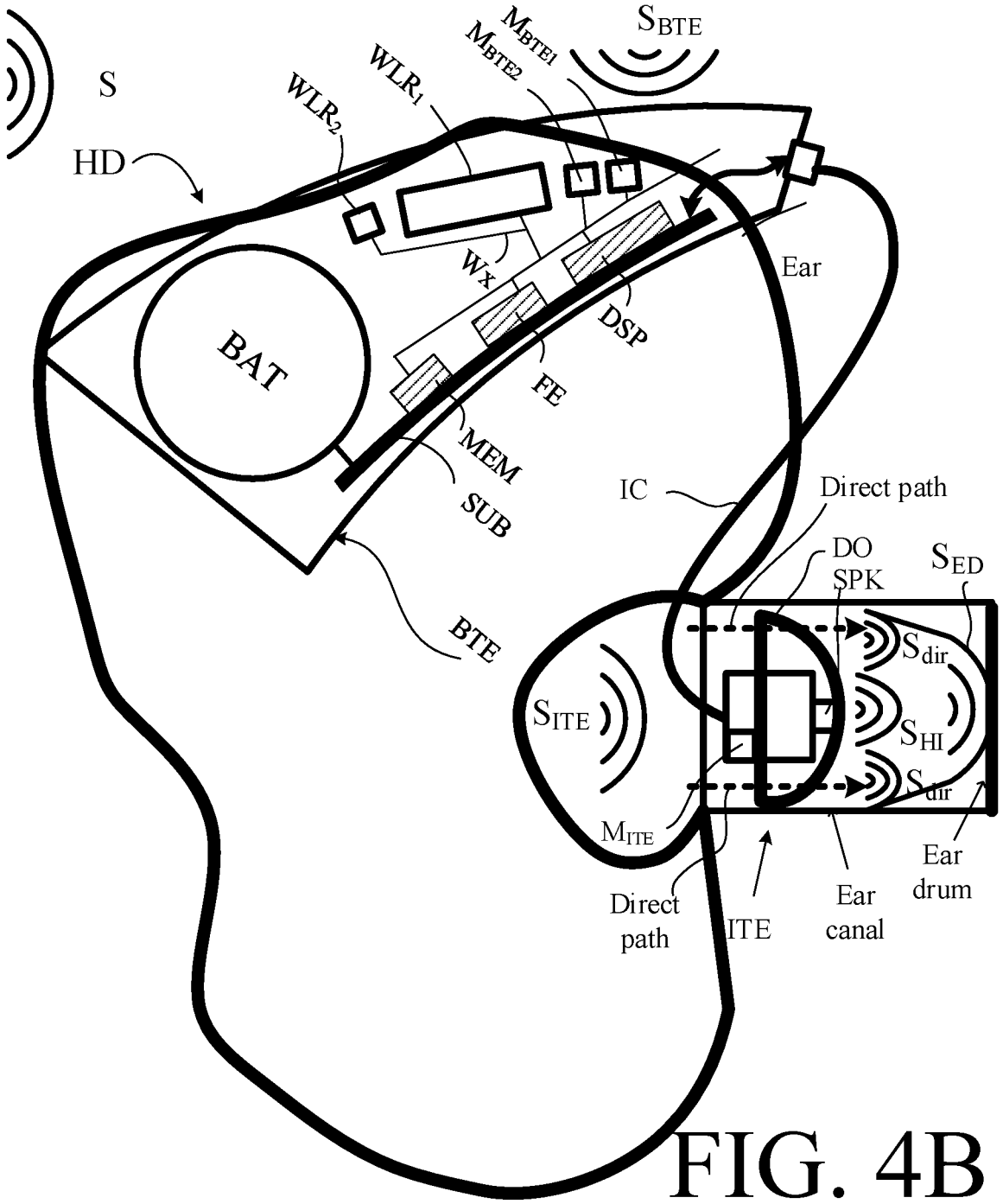

Hearing aids pick up sound from microphone(s) (e.g., located behind the pinna of the user), process the sound (e.g., amplifying and compressing), and present the sound to the eardrum of the listener, typically via a loudspeaker located close to the eardrum of the listener (cf. e.g. FIG. 4B). The situation is schematically depicted in FIGS. 1A and 1B and specifically discussed in relation to in the following in relation to these figures. For typical hearing instruments (HD), the total processing time $\tau_{HI}$ of the hearing instrument, i.e., the time it takes from the signal (denoted s(t), t representing time) is picked up by the microphone(s) until a processed version of the signal is output from the loudspeaker, is in the order of $\tau_{HI}$~8 ms. This signal is denoted $s'(t-\tau_{HI})$.

With open-fitting hearing aids (i.e. hearing aids comprising an earpiece (located at or in the ear canal), which does not tightly seal the opening between ear drum and environment sound, cf. e.g. FIG. 4B), the sound that is picked up at the microphone(s) also passes through a possible vent/dome of the device to find a—typically faster—road to the eardrum of the listener. In FIG. 1A, 1B, this signal is denoted as $s''(t-\tau_{dir})$. Typically, the time it takes for the sound to traverse through a vent/dome is in the order of microseconds, e.g. $\tau_{dir}$~50 μs.

In other words, a version of the acoustic input s(t) propagated via a direct acoustic propagation path (DAP in FIG. 1A, or lower arrow from input to output of the hearing aid in FIG. 1B) to the eardrum is added to the acoustic output $s'(t-\tau_{HI})$ from the hearing instrument. The directly propagated signal circumvents the hearing instrument, e.g. through a ventilation channel (to avoid occlusion, cf. e.g. FIG. 4A) or an otherwise intended (e.g. a dome, cf. e.g. FIG. 4B) or unintended propagation path (e.g. leakage between hearing instrument and walls of the ear canal, cf. e.g. FIG. 4A). Hence the acoustic signal presented to the user's eardrum comprises the sum of the contributions of the hearing instrument and the direct acoustic path, i.e. $s_{ED}=s'(t-\tau_{HI})+s''(t-\tau_{dir})$. The arguments to the functions s' and s" illustrating the potential '$_T$T of-phase' properties of the acoustic signals mixed at the eardrum, if $\tau_{HI}$ and are different (which will typically be the case). The combined signal reaching the ear drum is going to sound distorted due to the interaction of the two signal components $s'(t-\tau_{HI})$ and $s''(t-\tau_{dir})$.

Specifically, the presence of the signal component $s''(t-\tau_{dir})$ will cause a perceptually annoying comb-filtering effect, which is unwanted.

While presented here in an open-fitting hearing instrument context (cf. FIG. 4A, 4B), a similar problem occurs for head phones, in particular for closed-cup headphones. In this situation, the signal components $s''(t-\tau_{dir})$ denotes the signal leaking through the cups—also in this situation, $s''(t-\tau_{dir})$ is unwanted, as it interferes with the primary signal $s'(t-\tau_{HI})$ played from the loudspeakers inside the cups.

The present disclosure deals with methods for estimating and cancelling the signal component $s''(t-\tau_{dir})$.

Figure 2:
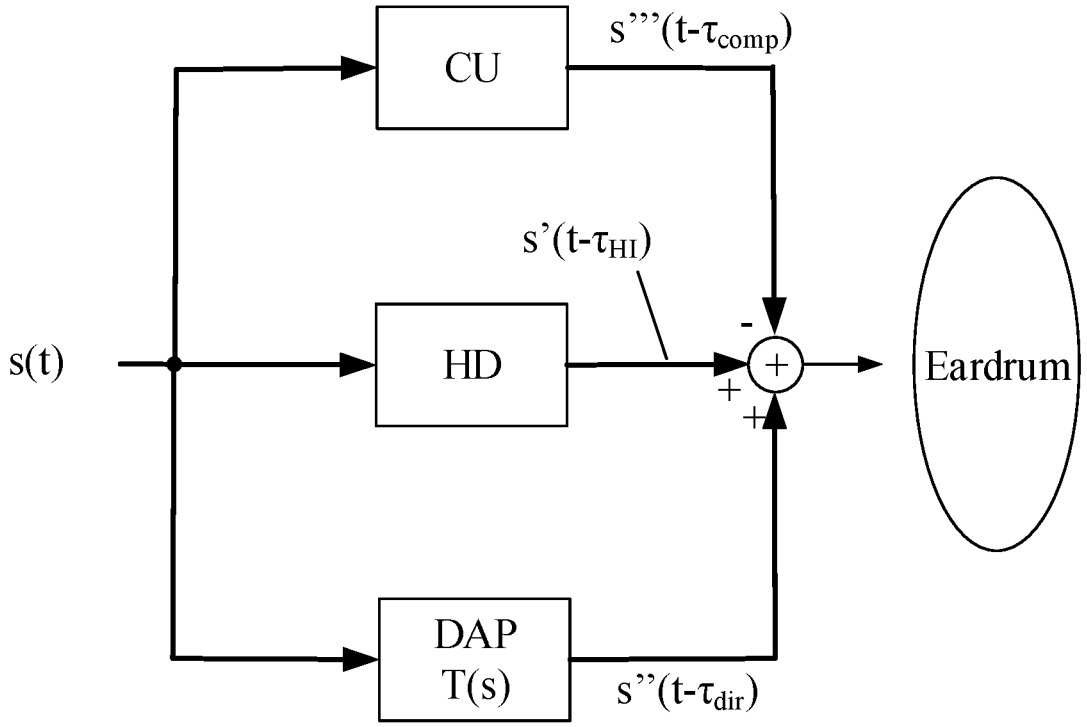

FIG. 2 shows a compensation of the interfering sound s"(t−τdir) of the scenario of FIG. 1A, 1B. As indicated in FIG. 2, a proposed solution is to estimate the interfering signal $s''(t-\tau_{dir})$ and to subtract it from the loudspeaker signal (electrically or acoustically) in order to cancel (or diminish/attenuate) it.

In FIG. 2, the hearing instrument (HD) illustrated in FIG. 1A, 1B is shown as a single unit (HD). The interfering sound $s''(t-\tau_{dir})$ is modelled as the microphone signal s(t), passed through an acoustic channel (direct acoustic path, DAP) characterized by a transfer function T(s). The basic idea is to introduce a compensation unit (CU), which processes the microphone signal s(t) to produce an output signal $s'''(t-\tau_{comp})$, which ideally is a close approximation of the interfering signal $s''(t-\tau_{dir})$. In other words, ideally, $s'''(t-\tau_{comp})=s''(t-\tau_{dir})$, so that when subtracted from the signal $s'(t-\tau_{HI})$ from the hearing device (e.g. before loudspeaker playback), the presence of the interfering component $s''(t-\tau_{dir})$ is cancelled out.

As comb-filtering mainly is perceived at lower frequencies, the signal component to be cancelled may only be estimated at frequencies below a certain threshold, e.g. below 2 kHz or below 1 kHz.

Typically, the compensation unit (CU) will be physically part of the hearing device (HD), e.g. hearing aid (so in this sense, 2 is misleading). However, whereas the traditional signal path in the hearing device may have a delay of $\tau_{HI}$~8 ms, primarily due to the presence of analysis and synthesis filter banks, the compensation unit (CU) (integrated in the hearing device, cf. e.g. processing part eCU in FIG. 4A, 5) may not need analysis- and synthesis-filter banks (examples of practical realizations of the compensation unit are given below). Consequently, the delay $\tau_{comp}$ through the compensation unit (CU) may be much smaller than $\tau_{HI}$—for example, $\tau_{comp}$ could be in the order of a few milliseconds, e.g., $\tau_{comp}$~3 ms.

In the following (and throughout the present disclosure), for simplicity, it is assumed that the transfer function T(s) of the acoustic channel (DPA) simply introduces a pure delay of $\tau_{dir}$. It is, however, straight-forward to generalize the exposition to allow for a more general transfer function T(s), which also performs some sort of frequency-shaping (e.g. frequency dependent gain (amplification or attenuation, and/or phase change)). With typical values of $\tau_{comp}$~3 ms and $\tau_{dir}$~50 μs, it is clear that in order to estimate the signal $s''(t-\tau_{dir})$ correctly, the compensation unit (CU) needs to predict signal samples which are $\tau_{pred}=\tau_{comp}-\tau_{dir}$ seconds in the future, compared to the signal samples that the compensation unit can output. With the typical values above, $\tau_{pred}$ could be in the order of ~2950 μs. e.g. by making predictions on a per frequency band level (=>$\tau_{dir}$ per frequency band)

Figure 3A:
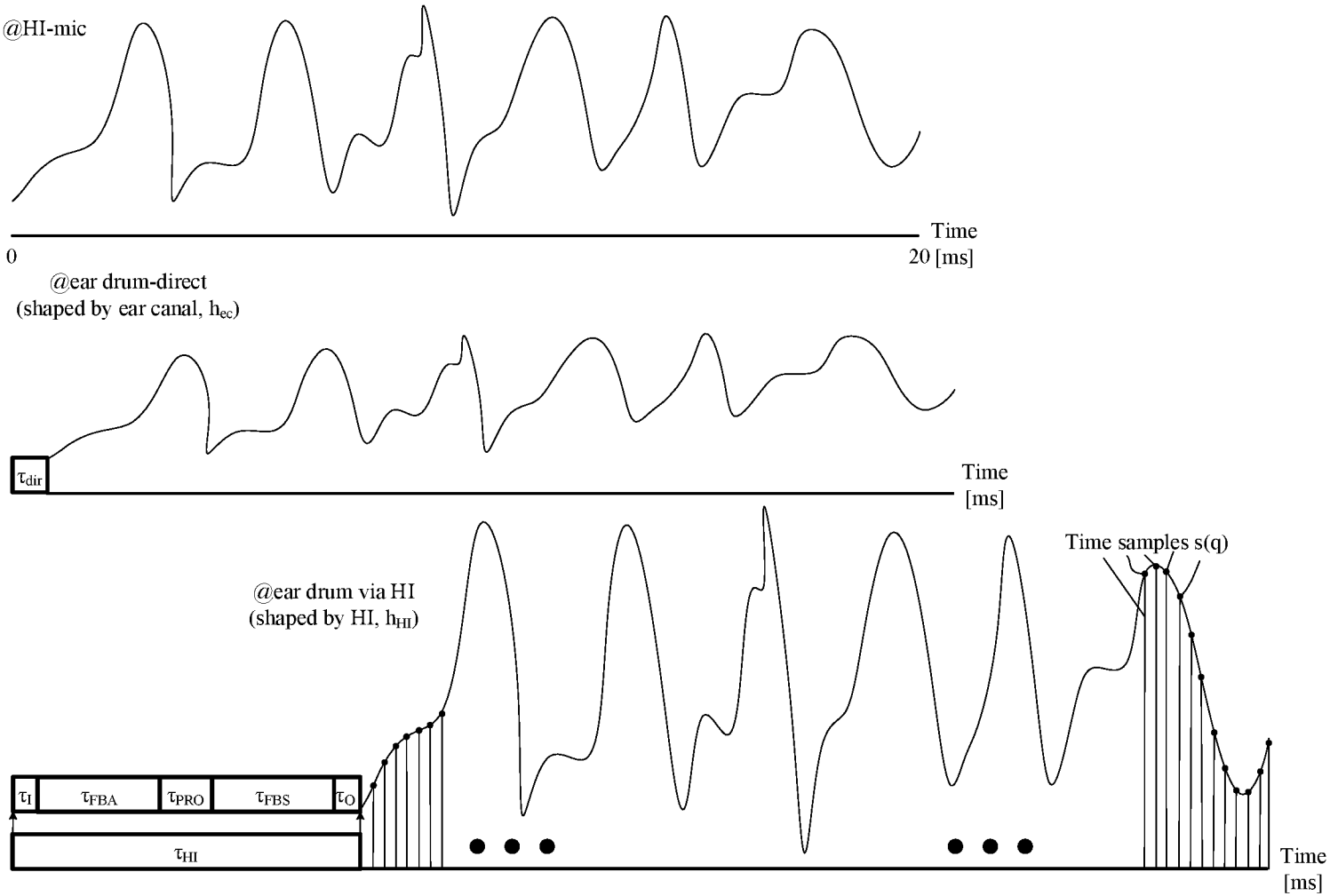
FIG. 3A shows a sound signal (sound pressure versus Time) impinging on an ear of a user in three different versions, the top graph shows the sound signal at a microphone of a hearing device when located at an ear canal of a user, the middle graph shows the sound signal at an ear drum of the user after propagation via a direct acoustic propagation path (e.g. through a vent or the like), and the bottom graph shows the sound signal at the ear drum of the user after processing in the hearing device.

FIG. 3A shows a sound signal (sound pressure (e.g. dB) versus Time (e.g. ms)) impinging on an ear of a user in three different versions. FIG. 3A illustrates a sound signal in a human audible frequency range impinging on the microphones of the hearing device (top graph), and at the ear drum as delayed by a direct acoustic path (middle graph) and as delayed by processing of the hearing device (bottom graph), respectively. The top graph (denoted @HI-mic) shows the sound signal at a microphone of a hearing device when located at an ear canal of a user. The time scale is indicated to be in milliseconds (ms) and the schematic sound waveform indicated to represent 20 ms of speech (e.g. corresponding to a few syllables of a word or a full word). The middle graph (denoted @ear drum-direct) shows the sound signal at an ear drum of the user after propagation via a direct acoustic propagation path (e.g. through a vent or the like, cf. e.g. DAP in FIG. 1A, input sound delayed by $\tau_{dir}$). The signal has been shaped (in frequency and time) by the ear canal vent configuration, here an attenuation and delay has been schematically applied (compared to the top graph). The shaping may be represented by an impulse response or a frequency transfer function (indicated by $h_{ec}$, in FIG. 3A). This transfer function may be estimated or measured (e.g. in advance of or during use of the hearing device), and is assumed known in the following (so that a value of the electric input signal at a hearing device microphone at a given time can be converted to a value at the ear drum when propagated through the direct acoustic path (DAP). The bottom graph (denoted @ear drum-HI) shows the sound signal at the ear drum of the user after processing in the hearing device (input sound delayed by $\tau_{HI}$). The transfer function applied by the hearing device to a signal received by a hearing device microphone to provide the acoustic output signal is denoted $h_{HI}$, here an amplification and a delay ($\tau_{HI}$) has been schematically applied to the microphone input signal (compared to the top graph). The hearing device transfer function $h_{HI}$ is assumed known. Likewise, the processing delay $\tau_{HI}$ (or and or delays of appropriate functional units) of the hearing device is assumed known. A distribution of the processing delay $\tau_{HI}$ of the hearing device on various functional units is indicated in the lower left part of FIG. 3A, here exemplified as $\tau_I$, $\tau_{FBA}$, $\tau_{PRO}$, $\tau_{FBS}$, $\tau_O$, referring to processing delays of the input unit, the analysis filter bank, the processor, the synthesis filter bank and the output unit, respectively. The transfer function, e.g. represented by a processing delay, may be stored in a memory (cf. e.g. $\tau_x$ stored in MEM in FIG. 5, x representing one or more of $\tau_I$, $\tau_{SPU}$, $\tau_O$, $\tau_{dir}$, $\tau_{HI}$ ($=\tau_I+\tau_{SPU}+\tau_O$)) of the hearing device and used in the prediction of the directly propagated sound signal $\hat{s}(n+\tau_{pred})$ from the environment to the eardrum of the user (around and/or through/via the hearing device). It is assumed that the predicted value of the directly propagated sound signal $\hat{s}''(t_n+\tau_{dir})$ is appropriately aligned in time with real directly propagated sound signal $s''(t_n+\tau_{dir})$ using the mentioned delay-estimates, cf. 3A and FIG. 5. The vertical lines with solid dots (●) in the top In the left and right parts of the bottom graph) are intended to represent digitized values in the hearing device (denoted Time samples s(q) in FIG. 3A, q being a time (sample) index) of the analogue electric signal resented by the solid graph (as e.g. provided by an analogue to digital converter, cf. e.g. units AD in FIGS. 1A and 1B).

Figure 3B:
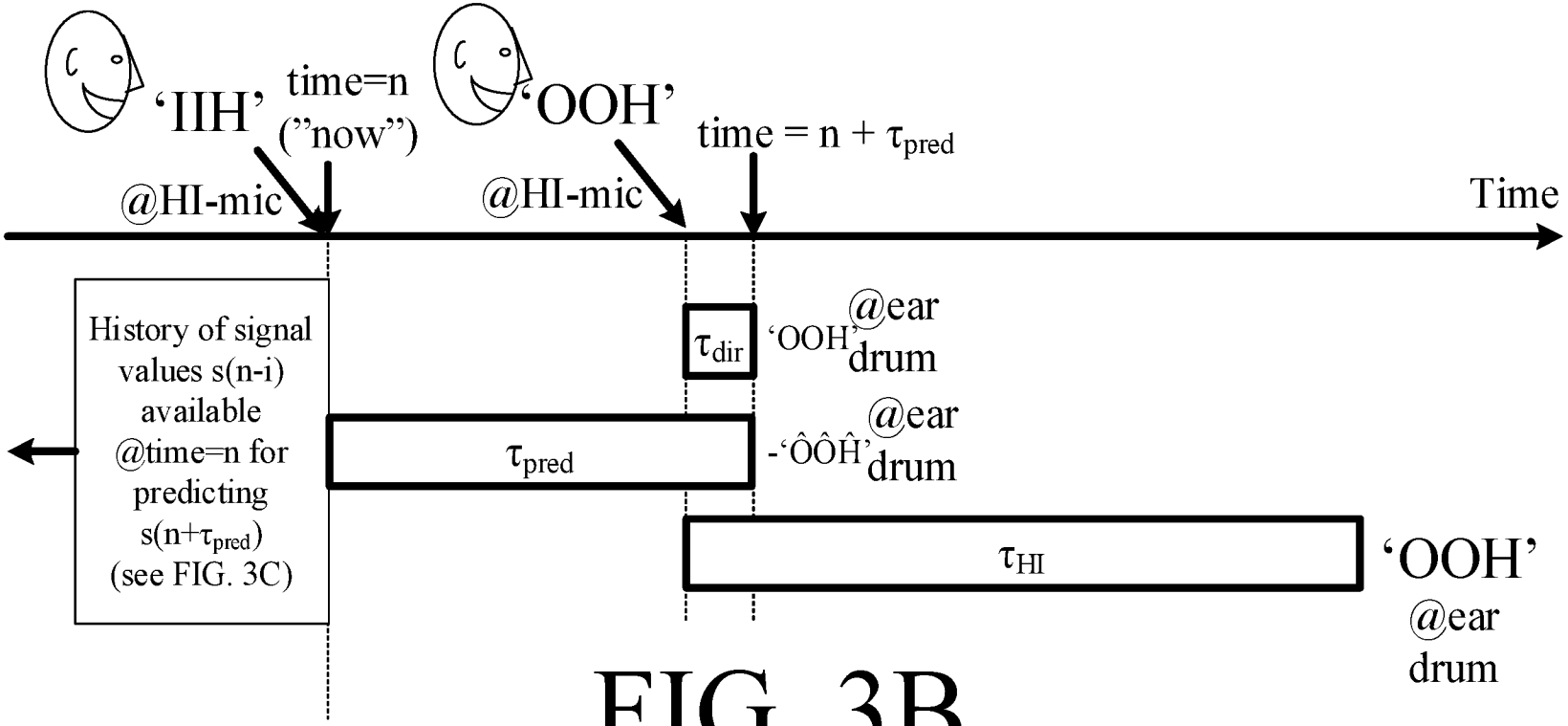
FIG. 3B schematically illustrates delays involved in a prediction of a sound signal to cancel sound propagated to the ear drum via direct acoustic propagation paths.

FIG. 3B schematically illustrates delays involved in a prediction of a sound signal to cancel sound propagated to the ear drum via direct acoustic propagation paths. FIG. 3B shows a time axis (bold arrow denoted Time) whereon speech events resulting in sound (speech-elements of a speaker) impinging on a microphone of a hearing device of a user are indicated. A time (index) n is denoted "now" to indicate a current point in time in the sense that time instances to the right of n are in the future, while time instances to the left of n are in the past. At time instance n ('now'), a (symbolic) speech element 'IHH' is indicated to impinge on the hearing device microphone (indicated by bold arrow denoted @HI-mic pointing at time=n). Another (symbolic) speech element 'OOH' is indicated on the future part of the time-axis (in practice, each speech element of relevance to the present disclosure may represent a time sample of the electric input signal, and thus be much shorter than the 'syllable like' indications 'IHH', 'OOH' of FIG. 3B). This speech element will propagate via a direct acoustic path (around or through the hearing device) from the environment to the ear drum and be present there a direct propagation delay ($\tau_{dir}$) later (as indicated by bold box (denoted $\tau_{dir}$) below the time-axis) at time=$n+\tau_{pred}$ on the time axis, and as indicated by 'OOH'@ear drum to the right of the bold $\tau_{dir}$-box. The task of the compensation unit is to predict this speech element based on recent, known (i.e. past) speech elements up till time n='now', to allow a prediction time (processing time) of $\tau_{pred}$ in advance of the appearance of the speech element in question at the ear drum to be able to subtract an estimate of the future speech element at time $n+\tau_{pred}$. The latter is indicated by bold box (denoted $\tau_{pred}$) below the bold $\tau_{dir}$-box and the indication by—'ÔÔH'@ear drum to the right of the bold $\tau_{pred}$-box. To predict the future speech element information of recent (past) speech elements are used (based on assumptions of correlations typically present in speech). The past is indicated in FIG. 3B by the box with left-pointing arrow denoted History of signal values s(n−i) available @time=n for predicting $s(n+\tau_{pred})$ (see FIG. 3C)). To illustrate the (typically much larger delay ($\tau_{HI}$) of the hearing device (HD) (due to processing, e.g. in filter banks) compared to the delay ($\tau_{dir}$) of the direct acoustic propagation path, bold box (denoted $\tau_{HI}$) is indicated in the lower right part of FIG. 3B. A processed version of the speech element 'OOH' is shown to appear at the ear drum from the loudspeaker of the hearing device time delay $\tau_{HI}$ after its appearance at the microphone of the hearing device (as indicated by 'OOH'@ear drum to the right of the bold $\tau_{HI}$-box), as also schematically shown in FIG. 3A.

Fortunately, many sound signals of interest to humans, e.g. speech, music, etc., have a structure that allows such prediction (including a certain (short-time) periodicity (correlation) of the sound signal). Several methods can be envisioned to perform the prediction.

Figure 3C:
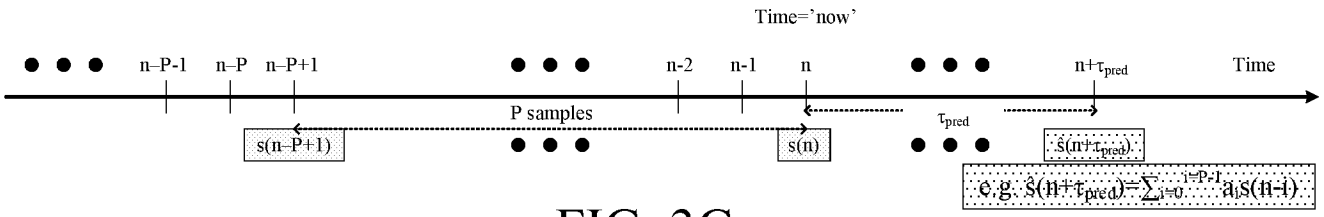
FIG. 3C illustrates an exemplary prediction of future samples of an electric input signal representing the sound signal based on current and past samples of the electric input signal.

FIG. 3C illustrates an exemplary linear prediction of future samples $\hat{s}(n+\tau_{pred})$ of an electric input signal representing the sound signal based on current s(n) and past s(n−i) (i=1, . . . , P−1) samples of the electric input signal. The linear prediction methods predict the future signal sample of interest based on a linear combination of signal samples that the compensation unit has access to:

$$\hat{s}(n+\tau_{pred})=\Sigma_{i=0}^{P-1}a_i s(n-i). \quad \text{Eq. (1)}$$

where n is an index representing (present) time, and $\hat{s}(n+\tau_{pred})$ represents an estimate (prediction) of signal s at time $\tau_{pred}$ later than the present time n (i.e. at time $t=n+\tau_{pred}$), where i is a time sample index), P is the number of previous sample values that are included in the prediction, and $a_i$ represents a weight in the prediction value of the $i^{th}$ previous sample, and s(n−i) is the value of the $i^{th}$ previous sample of the input signal (i.e. the value of s i time units before the present time n). This is schematically illustrated in FIG. 3C, where the predicted sample value $\hat{s}(n+\tau_{pred})$ is indicated in a solid box with dotted filling (together with Eq. (1)), and the P present and historic sample values s(n−i), i=0, . . . , (P−1), are each indicated in a solid box with grey background, below the bold time line denoted 'Time'. The same notation is used in FIG. 3D.

Figure 3D:
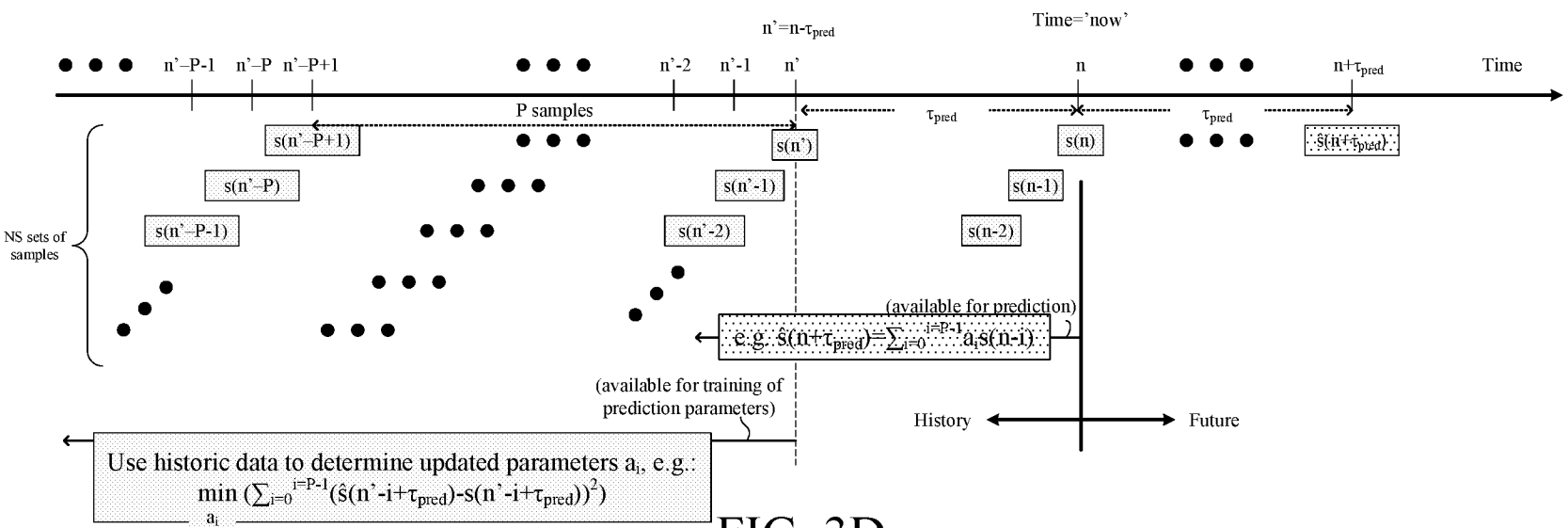
FIG. 3D illustrates an exemplary prediction of weight parameters for estimating a future sample of the electric signal based on a number of past samples of the electric signal.

FIG. 3D illustrates an exemplary prediction of weight parameters for estimating a future sample of the electric signal based on a number (K) of past samples of the electric signal, the number of past samples representing a time segment of the sound signal.

The coefficients $a_i$ of eq. (1) above related to linear prediction are generally time-varying and may be estimated based on past samples s(n−K+1), . . . , s(n).

More generally, the future signal sample of interest may be based on a linear or non-linear combination of the past and current signal samples available to the compensation unit (e.g. eCU/CU in FIG. 4A, 5), $$\hat{s}(n+\tau_{pred})=f(s(n-P+1), \ldots, s(n)),$$

where f(.) is a pre-determined or adaptive mapping of the past/current signal samples to the future samples.

The time-varying coefficients $a_i$ or more generally the time-varying function f(.), may be estimated from past signal samples. Specifically, based on past samples, s(n'−

K+1), . . . , s(n'), s(n), where $n=n'+\tau_{pred}$ (see FIG. 3D), the coefficients $a_i$, i=0, . . . , P−1 may be estimated, which minimize the mean-square prediction error $$\min_{a_i} \sum_n (\hat{s}(n' + \tau_{pred}) - s(n' + \tau_{pred}))^2, \quad \text{Eq. (2)}$$

where sample index n' is chosen such that past s(n'−K+1), . . . , s(n') and current s(n) samples are used in the minimization. This minimization problem is quadratic in the unknown coefficients $a_i$, i=0, . . . , P−1, which means that a well-known closed-form expression for the solution exists. New coefficients $a_i$, i=0, . . . , P−1 may be determined/adapted as a function of time, e.g., whenever a new sample s(n) is available (as illustrated in FIG. 3D). In the left part of FIG. 3D, i.e. to the left of the dashed vertical line (cf. left-pointing arrow denoted 'available for training of prediction parameters'), data that are indicated, which are known by the hearing device in sufficiently long time (namely the prediction time $\tau_{pred}$) in advance of where determination of the prediction value $\hat{s}(n+\tau_{pred})$ is needed to be initiated (i.e. at time n denoted 'now'). In other words we need to now, at least one preferably several) series of data, each comprising P historic values of the input sound signal (s(n'−P+1), . . . , s(n')) and a corresponding (historic) actual value of the input sound signal $s(n'+\tau_{pred})$ at time n'+the prediction time, $\tau_{pred}$. Preferably a number NS of previous sets of historic values may be included in the optimization (amounting to a total of K samples, as mentioned above, K≥P). This is indicated by the line of samples indicated in grey boxes just below the bold time line (denoted Time). As indicated in Eq. (2) above, appropriate weights $a_1$ may thereby be determined for a linear prediction algorithm from the (recent) historic data of the input sound signal (K samples). In a similar manner, the non-linear function f(.) may be determined (and adapted) as a function of time by solving $$\min_{f(.)} \sum_n (\hat{s}(n + \tau_{pred}) - s(n + \tau_{pred}))^2$$

whenever new samples s(n) are available (or f(.) may be updated at a slower rate).

The number of past samples (defined by parameters P and K, respectively, K≥P) should be chosen with a view to the nature of speech (or other sound signals of relevance to the user) large enough to catch characteristics of the present sound signal, e.g. speech (e.g. a time period $T_0$ of a fundamental frequency $F_0$ of current speech), but not so long that it includes speech (e.g. from another source) that is not relevant for the prediction of present speech elements. In practice P, K should be chosen to cover a time range smaller than 1 s, e.g. smaller than 100 ms, e.g. to cover a time range between 1 ms and 50 ms, e g smaller than 25 ms. Preferably, P, K should be chosen to include a time range spanning one to three time periods of the fundamental frequency of interest. Fundamental frequencies for male persons are e.g. typically in the range from 85 Hz to 180 Hz. If e.g. the fundamental frequency $F_0$ is 100 Hz (time period $T_0=1/F_0=10$ ms), and if the sampling frequency $f_s$ of an analogue to digital converter of a microphone signal is 20 kHz providing a sampling period $T_s$ (time between samples) of $T_s=1/f_s=0.050$ ms, then a time period of the fundamental frequency would correspond to 10 ms/0.050 ms=200 samples. In such case, P (and K) should preferably be chosen to be at least 200, e.g. in the range between 200 and 1000 samples. In general P, K should be chosen to be larger than the number of samples corresponding to a time period of the maximum fundamental frequency expected to occur in the sound signals considered. On the other hand, P, K should be chosen to be small enough to predominantly cover sound segments for which the periodicity (or correlation) is relatively constant, e.g. within a predetermined variance threshold. The system may be configured to determine a fundamental frequency of the current sound signal and to dynamically determine an appropriate value for the parameter P. In any case P (and K) may be limited by a computing capacity (available power budget) of the device in question, here a hearing device, e.g. a hearing aid.

Figure 3E:
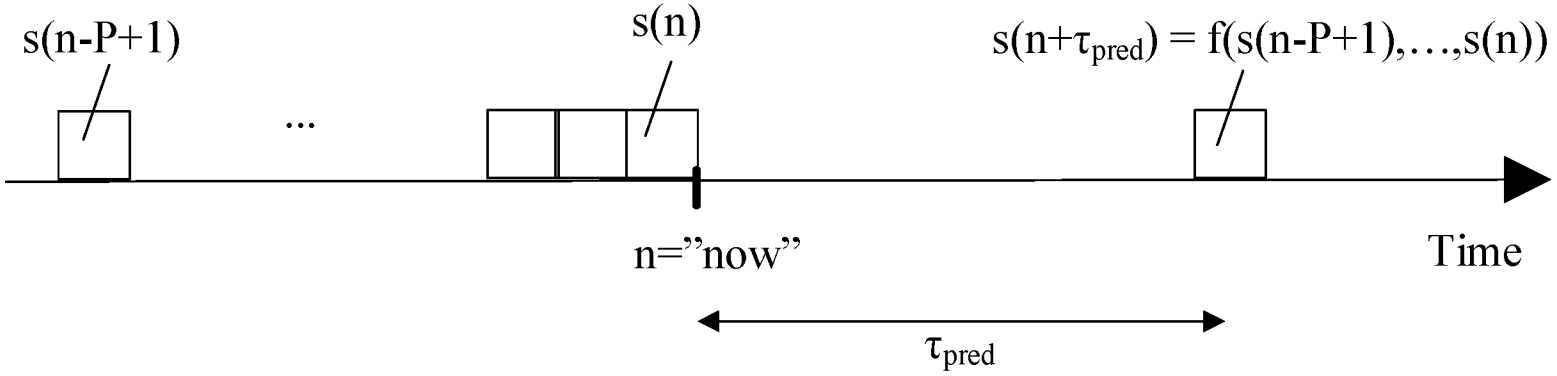
FIG. 3E schematically illustrates an algorithm for estimating a future sample of the electric input signal representing the sound signal based on P past samples of the electric signal, FIG. 4A schematically shows an ITE-style hearing device according to an embodiment of the present disclosure.

FIG. 3E schematically illustrates such non-linear algorithm for estimating a future sample of the electric input signal representing the sound signal based on P past samples of the electric signal For example, f(.) may be realized in terms of a neural network, whose parameters/weights are updated/adapted e.g., by applying the backpropagation algorithm in a supervised learning setup, where the input to the network is past samples, e.g., s(n'−P+1), . . . s(n'), and desired output of the network are signal samples $s(n'+\tau_{pred})$, $\tau_{pred}$ samples ahead in time—obviously, n' is chosen such that only past and current (=the correctly 'predicted')) samples are involved in the weight updates.

Backpropagation may not always be updated, e.g. only be updated if the error is above a predetermined threshold. Alternatively, the update may run at an auxiliary device. Whether signals are transmitted to the auxiliary device may depend on the size of the error signal.

It is obviously also possible to estimate the linear/non-linear mapping in an offline optimization procedure, and then maintaining a fixed map f(.) during operation of the hearing instrument.

Several extensions of the basic idea exist:

Frequency weighting: Rather than finding the prediction $\hat{s}(n+\tau_{pred})$ that minimizes the mean-squared error, one might be interested in minimizing the prediction error in a particular frequency region. This may be achieved e.g., by minimizing a frequency-weighted prediction error, $$\min_{f(.)} \sum_n ((\hat{s}(n + \tau_{pred}) - s(n + \tau_{pred})) * h(l))^2,$$

where * denotes linear convolution, and where h(l) is the impulse response of a frequency-shaping filter, e.g., a band-pass filter that emphasizes spectral regions where prediction accuracy is of highest interest, and where l is a frequency index.

Figure 8A:
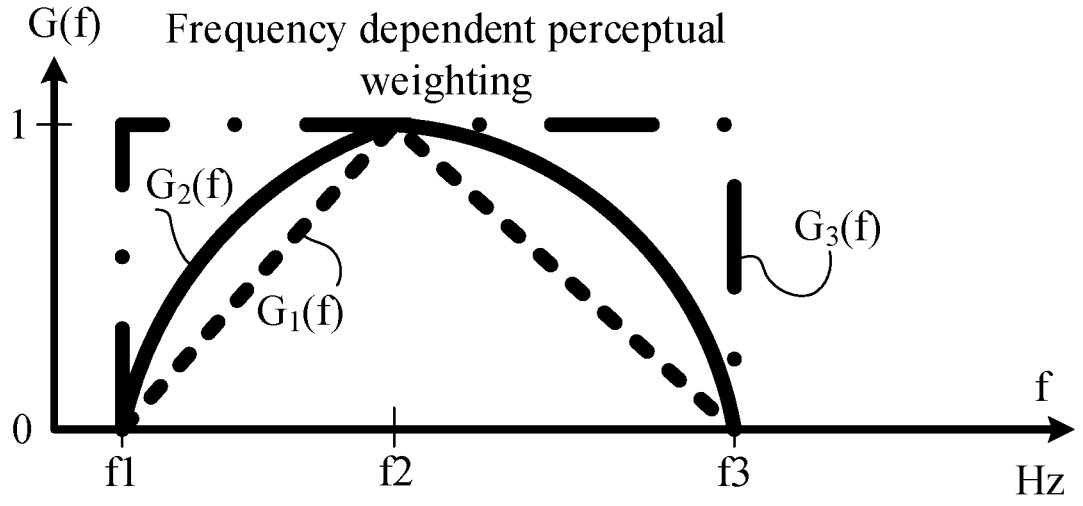
FIG. 8B shows an exemplary perceptual masking parameter functions G(f).

Perceptual weighting: Rather than finding the prediction $\hat{s}(n+\tau_{pred})$ that minimizes the mean-squared error, it is relevant to find the prediction that leads to the least perceptually objectionable signal. This may be achieved by minimizing a prediction error, which is weighted as a function of time and frequency, $$\min_{f(.)} \sum_n ((\hat{s}(n + \tau_{pred}) - s(n + \tau_{pred})) * g(1, n))^2, \quad \text{Eq. (3)}$$

where g(l,n) denotes a time-varying impulse response. The purpose of g(l,n) is to emphasize perceptually important spectro-temporal regions and de-emphasize less important or irrelevant regions. In particular, g(l,n) may be found by observing that the total signal presented to the eardrum of the user consists of the direct sound and the prediction error signal $\hat{s}(n+\tau_{pred})-s(n+\tau_{pred})$. The presence of the direct sound is going to mask the prediction error signal at certain frequencies (i.e., making the imperceptible (e.g. below a first threshold frequency, e.g. 100 Hz) and, hence, un-important at those frequencies). This masking effect may be estimated by applying a masking model (or more generally, an auditory model) to the direct signal (which is accessible in the hearing instrument). From the masking model, a masked threshold may be computed, from which a time-varying, spectral weighting function g(l,n) may be computed. In addition, S may be normalized with respect to the input level such that the error does not depend on the input level. An exemplary frequency dependent masking function G(f), f representing frequency, is schematically illustrated in FIG. 8A. G(f) may e.g. represent the frequency dependent part of masking function g(l,n) in the above minimization equation. A time dependency of masking function g(l,n) may be related to level dependent masking.

Transient rejection: when performing the actual signal prediction, one might experience large estimation errors at speech onsets and offsets. These errors may materialize as large transients in the predicted signal $\hat{s}(n+\tau_{pred})$. It may be advantageous to monitor the predicted signal and detect situations, where it exhibits large and sudden amplitude/energy increases—in this situation, one may choose to override (e.g. overwrite) or limit the output value, e.g., setting the prediction to a fixed value, whenever a transient is detected:

$$\hat{s}(n+\tau_{pred})=\text{const.}$$

Multiple microphones: it is conceptually straight-forward to extend the basic idea so that prediction of future samples is based on multiple microphone signals. This would allow beamforming to make the method more robust in acoustically noisy situations. The equivalent of Eq. (1) determining a linear prediction of the future signal sample of interest based on a linear combination of signal samples that the compensation unit has access to for a multi-microphone configuration (where Q is the number of microphones):

$$\hat{s}(n+\tau_{pred})=\Sigma_{q=1}^{Q}\Sigma_{i=0}^{P-1}a_{i,q}s_q(n-i) \quad \text{Eq. (4)}$$

where $s_q(n-i)$ is the sound signal received at the q'th microphone at time index (n−i), and $a_{i,q}$ is the weight parameter of the (n−i)'th sound sample of the q'th microphone, q=1, . . . , Q.

FIG. 4A schematically illustrates an ITE-style hearing device according to an embodiment of the present disclosure. The hearing device (HD), e.g. a hearing aid comprises or consists of an ITE-part comprising a housing (Housing), which may be a standard housing aimed at fitting a group of user's, or it may be customized to a user's ear (to provide an appropriate fitting to the outer ear and/or the ear canal). The housing schematically illustrated in FIG. 4A has a symmetric form, e.g. around a longitudinal axis from the environment towards the ear drum (Eardrum) of the user (when mounted), but this need not the case. The hearing device may be configured to be located in the outer part of the ear canal, e.g. partially visible from the outside, or it may be configured to be located completely in the ear canal, possibly deep in the ear canal, e.g. fully or partially in the bony part of the ear canal.

To minimize leakage of sound (played by the hearing device towards the ear drum of the user) from the ear canal, a good mechanical contact between the housing of the hearing device and the Skin/tissue of the ear canal is aimed at. In an attempt to minimize such leakage, the housing of the ITE-part may be customized to the ear of a particular user.

The hearing device (HD) comprises a number Q of microphones $M_q$, i=1, . . . , Q, here two (Q=2). The two microphones ($M_1$, $M_2$) are located in the housing with a predefined distance d between them, e.g. 8-10 mm, on a part of the surface of the housing that faces the environment when the hearing device is operationally mounted in or at the ear of the user. The microphones ($M_1$, $M_2$) are e.g. located on the housing to have their microphone axis (an axis through the centre of the two microphones) point in a forward direction relative to the user, e.g. a look direction of the user (as e.g. defined by the nose of the user, e.g. substantially in a horizontal plane), when the hearing device is mounted in or at the ear of the user. The microphones are configured to convert sound (S1, S2) received from a sound field S around the user at their respective locations to respective (analogue) electric signals (s1, s2) representing the sound. The microphones are coupled to respective analogue to digital converters (AD) to provide the respective (analogue) electric signals (s1, s2) as digitized signals (s1, s2). The digitized signals may further be coupled to respective filter banks to provide each of the electric input signals (time domain signals) as frequency sub-band signals (frequency domain signals). The (digitized) electric input signals (s1, s2) are fed to a signal processor (SPU) for processing the audio signals ($s_1$, $s_2$), e.g. including one or more of spatial filtering (beamforming), (e.g. single channel) noise reduction, compression (frequency and level dependent amplification/attenuation according to a user's needs, e.g. hearing impairment), spatial cue preservation/restoration, etc. The signal processor (SPU) may e.g. comprise the mentioned filter banks (e.g. analysis as well as synthesis filter banks). The signal processor (SPU) is configured to provide a processed signal ŝ comprising a representation of the sound field S (e.g. including an estimate of a target signal therein). The processed signal ŝ is fed to an output transducer (here a loudspeaker (SPK), e.g. via a digital to analogue converter (DA), for conversion of a processed (electric) signal $s_{out}$ (or analogue version $s_{out}$) to a sound signal $S_{out}$.

In a mode of operation, the hearing device is configured to couple the output ŝ of the signal processor (SPU) (directly) to the loudspeaker (SPK) (possibly via the DA-converter (DA)).

The hearing device may e.g. comprise a venting channel (Vent) configured to minimize the effect of occlusion (when the user speaks). In addition to allowing an (un-intended) acoustic propagation path from a residual volume (cf. Res. Vol in FIG. 4A) between a hearing device housing and the ear drum to be established, the venting channel also provides a direct acoustic propagation path of sound from the environment to the residual volume. The directly propagated sound $S_{dir}$, reaching the residual volume is mixed with the acoustic output of the hearing device (HD) to create a resulting sound $S_{ED}$ at the ear drum. The delay of the direct acoustic propagation path (and thus of the directly propagated sound $S_{dir}$) is indicated as $\tau_{dir}$.

In a mode of operation, where active noise suppression (ANS) is activated, the hearing device is configured to couple the output $\hat{s}$ of the signal processor (SPU) to the loudspeaker (SPK) via a combination unit (here sum unit '+'). In the sum unit ('+'), an (equivalent electric) estimate $\hat{s}_{dir}$ of a directly propagated acoustic signal $S_{dir}$ (e.g. through a vent (Vent) or other leakage channels, e.g. between the housing and the walls of the ear canal) is subtracted from the output $\hat{s}$ of the signal processor (SPU) to provide a resulting output signal $s_{out}$ which is fed to the loudspeaker (SPK) (possibly via the DA-converter (DA)). In this 'ANS-mode', the acoustic signal $S_{out}$ provided by loudspeaker (SPK) represents an estimate of sound $\hat{S}$ in the environment sound field S (at least partially) compensated for directly propagated sound $S_{dir}$ reaching the residual volume (Res. Vol). The resulting sound $S_{ED}$ at the eardrum is then equal to the (possibly enhanced, e.g. amplified) estimate $\hat{S}$ of the environment sound S plus the directly propagated sound $S_{dir}$, minus an estimate $\hat{S}_{dir}$ of the directly propagated sound $S_{dir}$. The estimate $\hat{s}_{dir}$ of a directly propagated acoustic signal $S_{dir}$ is preferably shaped to match the shaping by the acoustic propagation path. Ideally (when $\hat{S}_{dir}=S_{dir}$), $S_{ED}=\hat{S}$, i.e. the directly propagated sound has been compensated).

The input unit (e.g. comprising one or more transducer(s), e.g. microphone(s), appropriate AD-converters, analysis filter banks, etc., as the case may be), the signal processor (SPU, e.g. comprising appropriate analysis and synthesis filter banks, as the case may be, and one or more processing algorithms for enhancing the input audio signal(s)), the combination unit ('+'), and the output unit (e.g. comprising appropriate digital to analogue converter, output transducer, e.g. loudspeaker, etc., as the case may be) form part of or constitute a forward signal path of the hearing device. The forward signal path is configured to pick up sound, process the sound and provided a processed version of the sound to the user, e.g. the user's ear drum. The forward path of the hearing device (HD) has (at a given point in time) a propagation delay $\tau_{HI}$ from an acoustic input to the acoustic output. The propagation delay $\tau_{HI}$ of the hearing device (HD) may be predetermined or adaptively determined. The propagation delay $\tau_{HI}$ of the hearing device (HD) is a sum of the processing delay of each of the elements in the forward path (e.g. input unit, signal processor, combination unit, output unit, cf. e.g. FIG. 3A). The propagation delay $\tau_{dir}$ of a direct acoustic path (e.g. through a ventilation channel) may be characteristic for a given hearing aid style (e.g. properties of a vent or dome), and possibly for a user's ear canal. Each of these individual processing delays may be known in advance (e.g. measured or estimated or adaptively determined), and accessible to the compensation unit, e.g. stored in a memory (MEM) of the hearing device. The transfer function of the direct path may e.g. be estimated as the feedback path from the output transducer to an input transducer (which are typically estimated by a feedback estimation unit of the hearing device to control feedback, i.e. to limit a risk of howl).

The hearing device comprises a compensation unit (CU, cf. dashed enclosure denoted CU ($\tau_{dir}$), $\tau_{dir}$ denoting the delay of the compensation unit CU). The compensation unit (CU) comprises a processing part (eCU) coupled to at least one of the input transducers (here M2) and for providing an (equivalent electric) estimate $\hat{s}_{dir}$ of the directly propagated sound $S_{dir}$. The compensation unit has (or is coupled to) a memory (MEM) wherein relevant information about the delay of the forward signal path of the hearing device is stored/accessible (e.g. the processing delays of the individual parts or elements as mentioned above). The compensation unit (CU), e.g. the processing part (eCU), may e.g. implement a prediction algorithm as described above in connection with FIG. 3A-3E, or in FIG. 5. Alternatively, it may be based on or comprise a neural network.

The hearing device comprises an energy source, e.g. a battery (BAT), e.g. a rechargeable battery, for energizing the components of the device.

FIG. 4B shows an embodiment of a hearing device (HD) according to the present disclosure. The exemplary hearing device (HD), e.g. a hearing aid, is of a particular style (sometimes termed receiver-in-the ear, or RITE, style) comprising a BTE-part (BTE) adapted for being located at or behind an ear of a user, and an ITE-part (ITE) adapted for being located in or at an ear canal of the user's ear and comprising a receiver (loudspeaker). The BTE-part and the ITE-part are connected (e.g. electrically connected) by a connecting element (IC) and internal wiring in the ITE- and BTE-parts (cf. e.g. wiring Wx in the BTE-part). The connecting element may alternatively be fully or partially constituted by a wireless link between the BTE- and ITE-parts.

In the embodiment of a hearing device in FIG. 4B, the BTE part comprises an unit comprising two input transducers (e.g. microphones) ($M_{BTE1}$, $M_{BTE2}$), each for providing an electric input audio signal representative of an input sound signal ($S_{BTE}$) (originating from a sound field S around the hearing device). The input unit further comprises two wireless receivers ($WLR_1$, $WLR_2$) (or transceivers) for providing respective directly received auxiliary audio and/or control input signals (and/or allowing transmission of audio and/or control signals to other devices, e.g. a remote control or processing device, or a telephone). The hearing device (HD) comprises a substrate (SUB) whereon a number of electronic components are mounted, including a memory (MEM), e.g. storing different hearing aid programs (e.g. parameter settings defining such programs, or parameters of algorithms, e.g. for prediction of future audio samples, e.g. comprising optimized parameters of a neural network) and/or hearing aid configurations, e.g. input source combinations ($M_{BTE1}$, $M_{BTE2}$, $M_{ITE}$, $WLR_1$, $WLR_2$), e.g. optimized for a number of different listening situations. In a specific mode of operation, one or more directly received auxiliary electric signals are used together with one or more of the electric input signals from the microphones to provide a beamformed signal provided by applying appropriate complex weights to (at least some of) the respective signals.

The substrate (SUB) further comprises a configurable signal processor (DSP, e.g. a digital signal processor), e.g. including a processor for applying a frequency and level dependent gain, e.g. providing beamforming, noise reduction, filter bank functionality, and other digital functionality of a hearing device, e.g. implementing a compensation unit, according to the present disclosure (as e.g. discussed in connection with FIGS. 4A and 5). The configurable signal processor (DSP) is adapted to access the memory (MEM) e.g. for selecting appropriate delay parameters and calculate weighting parameters for a prediction algorithm according to the present disclosure, as e.g. discussed in connection with FIG. 3A-3E. The configurable signal processor (DSP) is further configured to process one or more of the electric input audio signals and/or one or more of the directly received auxiliary audio input signals, based on a currently selected (activated) hearing aid program/parameter setting (e.g. either automatically selected, e.g. based on one or more sensors, or selected based on inputs from a user interface). The mentioned functional units (as well as other components) may be partitioned in circuits and components according to the application in question (e.g. with a view to size, power consumption, analogue vs. digital processing, acceptable latency, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals (e.g. interfaces to microphones and/or loudspeaker(s)). The input and output transducers may be individual separate components, or integrated (e.g. MEMS-based) with other electronic circuitry.

The hearing device (HD) further comprises an output unit (e.g. an output transducer) providing stimuli perceivable by the user as sound based on a processed audio signal from the processor or a signal derived therefrom. In the embodiment of a hearing device in FIG. 4B, the ITE part comprises the output unit in the form of a loudspeaker (also termed a 'receiver') (SPK) for converting an electric signal to an acoustic (air borne) signal, which (when the hearing device is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. The ITE-part further comprises a further input transducer, e.g. a microphone ($M_{ITE}$), for providing an electric input audio signal representative of an input sound signal ($S_{ITE}$) at the ear canal. Propagation of sound ($S_{ITE}$) from the environment to a residual volume at the ear drum via direct acoustic paths through the semi-open dome (DO) are indicated in FIG. 4B by dashed arrows (denoted Direct path). The direct propagated sound (indicated by sound fields $\tau_{dir}$) is mixed with sound from the hearing device (HD) (indicated by sound field $S_{HI}$) to a resulting sound field ($S_{ED}$) at the ear drum. The sound output $S_{HI}$ of the hearing device is preferably (at least in a specific mode of operation) configured to comprise a part that is intended to reduce (preferably) substantially eliminate the directly propagated sound from the environment to the ear drum as described in connection with FIGS. 3A-E, and 4B, 5.

The electric input signals (from input transducers $M_{BTE1}$, $M_{BTE2}$, $M_{ITE}$) may be processed in the time domain or in the (time-) frequency domain (or partly in the time domain and partly in the frequency domain as considered advantageous for the application in question).

The embodiments of a hearing device (HD) exemplified in FIGS. 4A and 4B are portable devices comprising a battery (BAT), e.g. a rechargeable battery, e.g. based on Li-Ion battery technology, e.g. for energizing electronic components of the BTE- and possibly ITE-parts. In an embodiment, the hearing device, e.g. a hearing aid, is adapted to provide a frequency dependent gain and/or a level dependent compression and/or a transposition (with or without frequency compression) of one or more frequency ranges to one or more other frequency ranges, e.g. to compensate for a hearing impairment of a user. The BTE-part may e.g. comprise a connector (e.g. a DAI or USB connector) for connecting a 'shoe' with added functionality (e.g. an FM-shoe or an extra battery, etc.), or a programming device, or a charger, etc., to the hearing device (HD).

Figure 5:
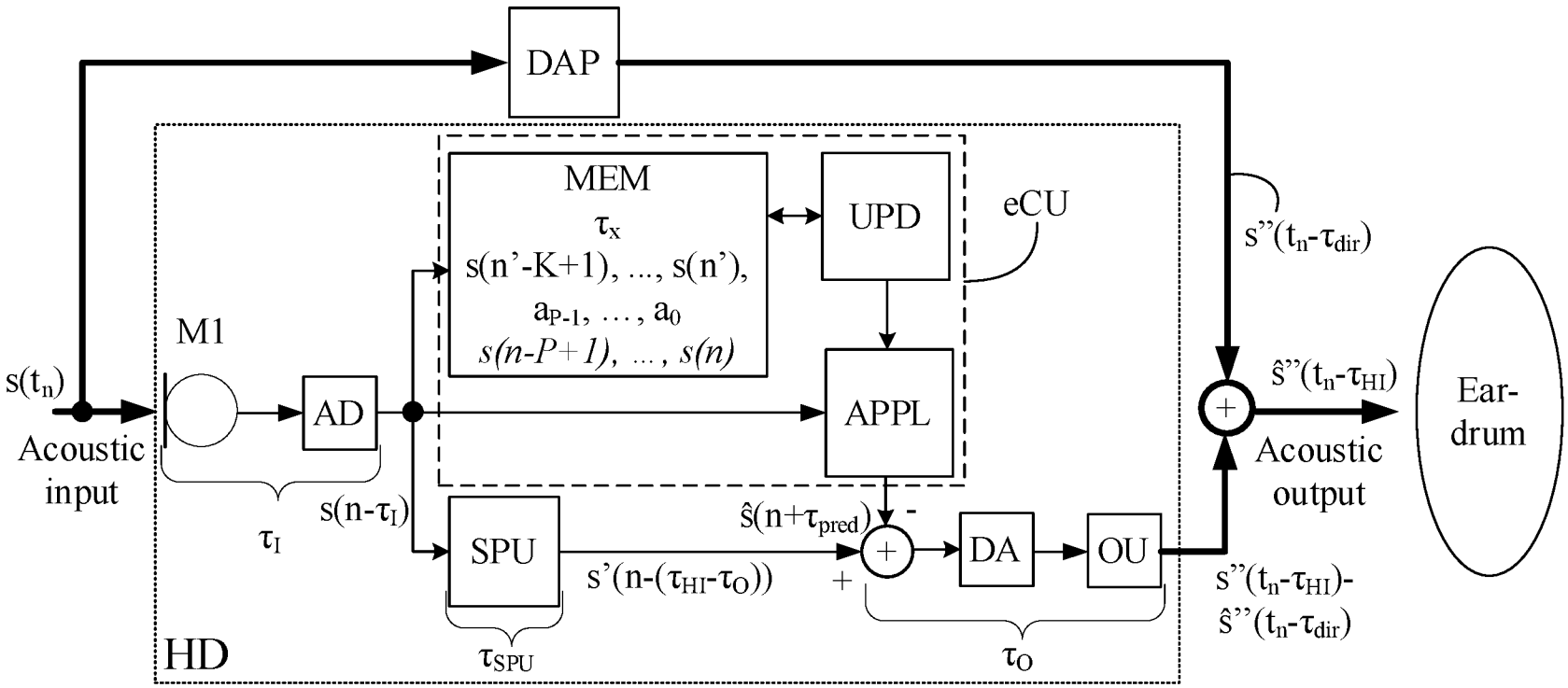
FIG. 5 shows a hearing device comprising a compensation unit according to an embodiment of the present disclosure.

FIG. 5 shows a hearing device comprising a compensation unit according to an embodiment of the present disclosure. In the embodiment of FIG. 5 the compensation unit (cf. e.g. CU in FIG. 4A) comprises an input stage (M1, AD), a processing part (eCU) of the compensation unit, and an output stage ('+', DA, OU), respectively). The hearing device (HD), e.g. a hearing aid or an earphone, is configured to play sound into an ear canal of a user. The hearing device (HD) comprises an input transducer, here a microphone (M1), for picking up sound $s(t_n)$ (Acoustic input) from a sound field S around the hearing device and providing a corresponding (analogue) electric input signal representing said sound. The analogue electric input signal is digitized by an analogue to digital converter (AD) providing the electric input signal as a digital signal $s(n-\tau_I)$, where n is a time index corresponding to time $t_n$. The AD converter is e.g. configured to digitize the analogue electric input signal $s(t_n)$ representing sound with a sampling rate of $f_s$=20 kHz (or more) and providing corresponding audio samples $s(n')=s(n-\tau_I)$ (cf. e.g. FIG. 3A). The total input delay $\tau_I$ is here indicated to be the sum of the delays of the microphone and the AD converter. The forward path of the hearing device (HD) further comprises a processor (SPU) for processing the (digitized) electric input signal s(n) to a processed signal. The delay of the processor is indicated as $\tau_{SPU}$. The forward path of the hearing device (HD) further comprises a combination unit for modifying the processed signal (here a SUM unit ('+') for subtracting an estimate of a directly propagated signal $s'(n-(\tau_{HI}-\tau_O))$, s' indicating that the signal value is intended to be the value of s a time prior to n corresponding to the argument $(n-(\tau_{HI}-\tau_O))$, to compensate for sound propagated to the ear drum of the user via a direct acoustic path (DAP) indicated by the bold arrow from Acoustic input to Acoustic output in FIG. 5. Thereby a (digital) compensated output signal is provided. The forward path of the hearing device (HD) may further comprise a digital to analogue converter (DA) for providing an analogue output signal from the digital compensated output signal. The digital compensated output signal is fed to the last functional unit of the forward path, output unit (OU), e.g. a loudspeaker or a vibrator of a bone conduction hearing device, for conversion to an acoustic signal s" (or a mechanical vibration of skull bone) (Acoustic output). The total output delay $\tau_O$ is here indicated to be the sum of the delays of the combination unit ('+'), the DA converter, and the output unit (OU). The forward path of the hearing device is defined from an acoustic input to the input transducer (microphone) to an acoustic output of the output transducer (e.g. a loudspeaker). The forward path has a forward signal propagation delay $\tau_{HI}$ of the hearing device. The size of the delay $\tau_{HI}$ of the hearing device is of course dependent on the functional components of the forward path (here $\tau_{HI}=\tau_I+\tau_{SPU}+\tau_O$). The size of the delay $\tau_{comp}$ of the compensation unit ('CU') is likewise dependent on the functional components of the compensation estimation path (here $\tau_{comp}=\tau_I+\tau_{eCU}+\tau_O$). In state of the art hearing devices the delay may e.g. vary between 3 ms and 10 ms dependening on the processing of signals of the forward path. The relevant delays of the hearing device, e.g. one or more of $\tau_{HI}$, $\tau_I$, $\tau_{SPU}$, $\tau_{eCU}$, and $\tau_O$, $\tau_{dir}$, $\tau_{temp}$ etc. is/are e.g. stored in a memory (MEM) accessible to algorithms of the hearing device (cf. parameter $\tau_x$ in memory MEM of the compensation unit (CU/eCU)). The hearing device further comprises a compensation unit (CU/eCU) for at least partially compensating for sound $s''(t_n-\tau_{dir})$ from the environment sound field that is propagated to the ear canal via a direct acoustic propagation path (DAP). In the embodiment of FIG. 5, the compensation unit (CU/eCU) comprises the memory unit (MEM) wherein historic values of the digitized input signal s(n−i), i=0, 1, . . . , P−1, are stored, where P−1 is the number of sample values prior to time n='now' that are included in the prediction of the directly propagated sound $\tau_{pred}$ later. The prediction delay $\tau_{pred}$ represents the effective processing time of the predictor (e.g. a prediction algorithm), cf. e.g. exemplary linear predictor in eq. (1). The update unit (UPD) is, as indicated in connection with FIG. 3D, configured to determine (and continuously update) weight parameters $a_i$ for eq. (1) based on the last P (successive) historic values (samples) s(n'−i), i=0, 1, . . . , P−1, of the electric input signal prior to and including the latest (current) sample for which the actual value of the sample arriving at the ear drum via the direct acoustic propagation path are known, cf. eq. (2). These values (denoted s(n'−K+1), . . . , s(n') in FIG. 3D and in the memory of FIG. 5) are stored in the memory (MEM). The update unit (UPD) may be configured to update the weight parameters $a_i$ after each new sample 'arrives' in the memory to provide current values of the weight parameters $a_{P-1}, \ldots, a_0$ using eq. (2) or as discussed in connection with FIG. 3D. The compensation unit (CU/eCU) further comprises application unit (APPL) for applying the updated weight parameters $a_{P-1}, \ldots, a_0$ to the current last P samples s(n−P+1), . . . , s(n) to provide the predicted value $\hat{s}(n+\tau_{pred})$ of the directly propagated sound using eq. (1). This value (appropriately taking account of delays in the hearing device) is subtracted from the processed signal of the signal processor (SPU) and fed to the DA converter etc. The hearing device (HD) thereby provides as an acoustic output signal a difference between the normal processed hearing aid signal (denoted $s''(t_n-\tau_{HI})$) and an estimate (prediction) of the current value of the direct propagated sound (denoted $\hat{s}''(t_n-\tau_{dir})$). As indicated by the bold 'acoustic combination unit' ('+') the direct propagated acoustic signal (denoted $s''(t_n-T_{dir})$) is (automatically) mixed with the acoustic signal from the hearing device to provide a compensated hearing device signal $\hat{s}''(t_n-\tau_{HI})$) at the ear drum.

Figure 6A:
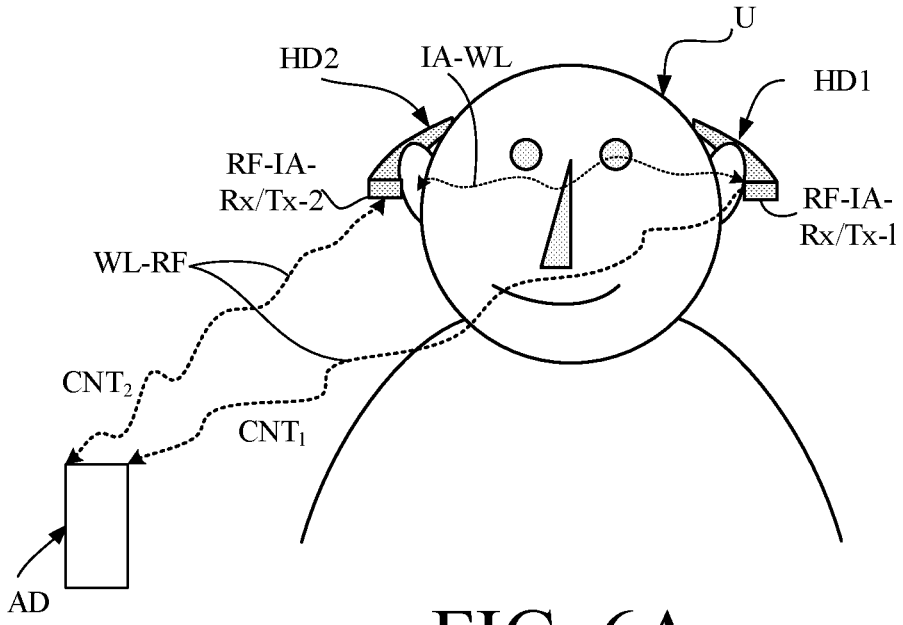
FIG. 6A shows an embodiment of a hearing system, e.g. a binaural hearing aid system, according to the present disclosure.
Figure 6B:
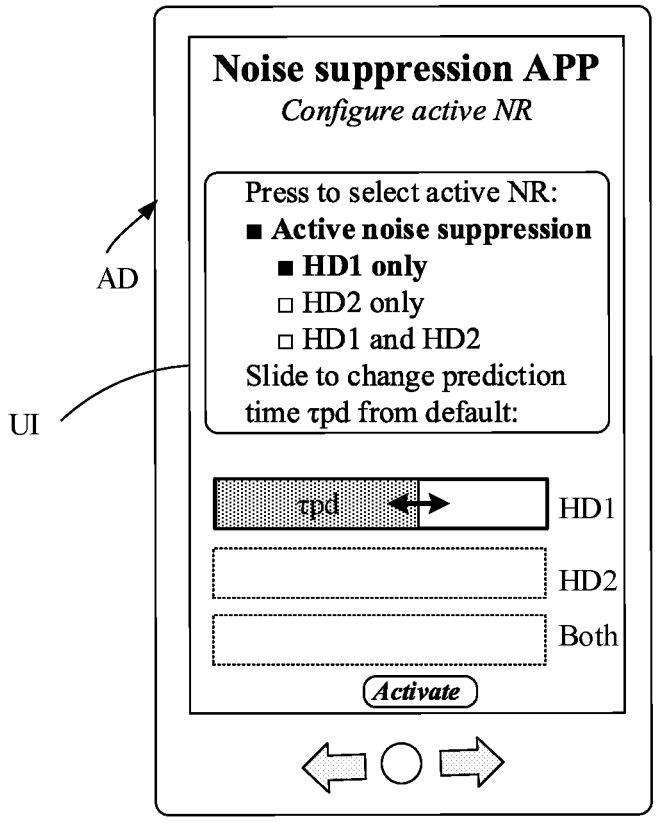
FIG. 6B illustrates an auxiliary device configured to execute an APP implementing a user interface of the hearing device or system from which an active noise suppression mode of operation can be selected and configured, FIG. 7A schematically shows a time variant analogue signal (Amplitude vs time) and its digitization in samples, the samples being arranged in a number of time frames, each comprising a number $N_s$ of samples, and FIG. 7B schematically illustrates a time-frequency representation of the time variant electric signal of FIG. 7A, in relation to a prediction algorithm according to the present disclosure, and FIG. 8A schematically illustrates a number of exemplary parameterized perceptual masking functions Gj(f)

FIG. 6A illustrates an embodiment of a hearing system, e.g. a binaural hearing aid system, according to the present disclosure. The hearing system comprises left and right hearing devices in communication with an auxiliary device, e.g. a remote control device, e.g. a communication device, such as a cellular telephone or similar device capable of establishing a communication link to one or both of the left and right hearing devices. FIG. 6B illustrates an auxiliary device configured to execute an application program (APP) implementing a user interface of the hearing device or system from which an active noise suppression mode of operation can be selected and/or configured.

FIG. 6A, 6B together illustrate an application scenario comprising an embodiment of a binaural hearing aid system comprising first (left) and second (right) hearing devices (HD1, HD2) and an auxiliary device (AD) according to the present disclosure. The auxiliary device (AD) comprises a cellular telephone, e.g. a SmartPhone. In the embodiment of FIG. 6A, the hearing devices and the auxiliary device are configured to establish wireless links (WL-RF) between them, e.g. in the form of digital transmission links according to the Bluetooth standard (e.g. Bluetooth Low Energy, or equivalent technology). The links may alternatively be implemented in any other convenient wireless and/or wired manner, and according to any appropriate modulation type or transmission standard, possibly different for different audio sources. The auxiliary device (e.g. a SmartPhone) of FIG. 6A, 6B comprises a user interface (UI) providing the function of a remote control of the hearing aid system, e.g. for changing program or mode of operation or operating parameters (e.g. volume) in the hearing device(s), etc. The user interface (UI) of FIG. 6B illustrates an APP (denoted 'Noise suppression APP') for selecting a mode of operation of the hearing system or device where active noise suppression (ANS) can be enabled (or disabled) (ANS can be individually activated in each of the left and right hearing devices (HD1, HD2) or in both). The APP allows a user to configure the delay of a prediction algorithm of the noise suppression system, e.g. to select on how many frames of known signal values a prediction should be based. In the screen of FIG. 6B, the Active noise suppression (ANS) mode of operation has been selected in the left hearing device (HD1) alone as indicated by the left solid 'tick-box' and the bold face indication 'HD1 only'. This may be relevant, in a scenario where a (loud) sound source is located to one side of the user, e.g. in a semi-stationary situation, e.g. at a table or in a car. A prediction time τpd (determining a number of historic values on which to base the prediction of the directly propagated signal components) can be selected for each configuration. In the current example only HD1 is selected for ANS, so the option for HD2 and both (HD1 plus HD2) is indicated by a dotted outline (not accessible).

In an embodiment, at least some of the calculations related to active noise suppression (e.g. sound prediction) are performed in the auxiliary device. In another embodiment, the calculations are performed in the left and/or right hearing devices. In the latter case the system may be configured to exchange the data between the auxiliary device and the hearing device(s). The hearing device (HD1, HD2) are shown in FIG. 6A as devices mounted at the ear (behind the ear) of a user (U). Other styles may be used, e.g. located completely in the ear (e.g. in the ear canal, cf. e.g. FIG. 4A), fully or partly implanted in the head, etc. Each of the hearing instruments comprise a wireless transceiver to establish an interaural wireless link (IA-WL) between the hearing devices, e.g. based on inductive communication or RF communication (e.g. Bluetooth technology). Each of the hearing devices further comprises a transceiver for establishing a wireless link (WL-RF, e.g. based on radiated fields (RF)) to the auxiliary device (AD), at least for receiving and/or transmitting signals, e.g. control signals, e.g. information signals, e.g. including audio signals. The transceivers are indicated by RF-IA-Rx/Tx-1 and RF-IA-Rx/Tx-2 in the right (HD2) and left (HD1) hearing devices, respectively.

Figure 7A:
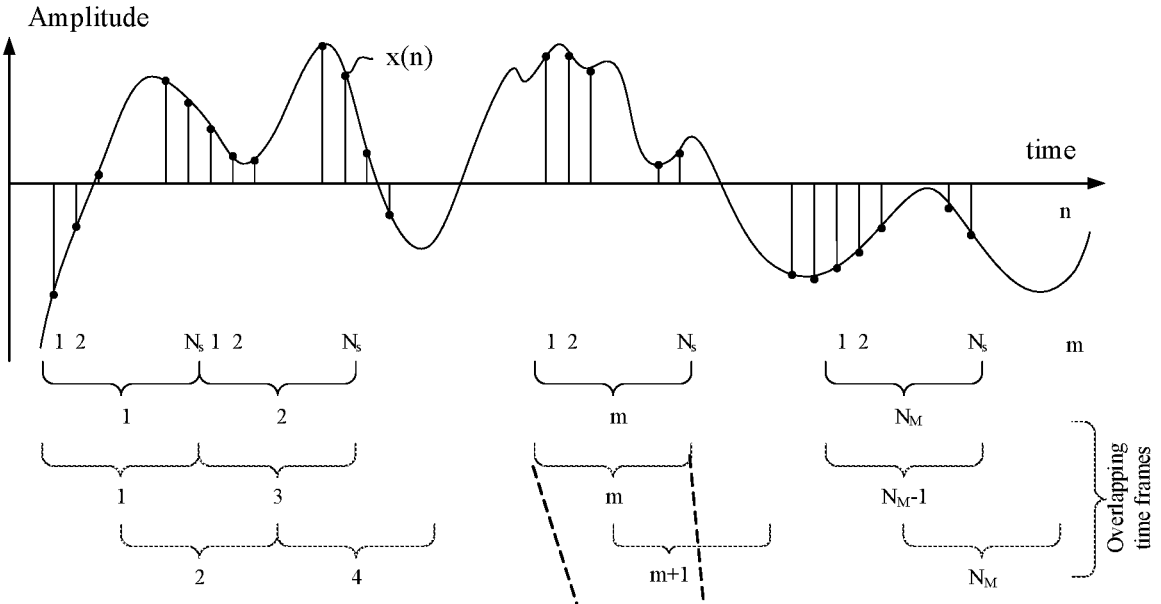

FIG. 7A schematically illustrates a time variant analogue signal (Amplitude vs time) and its digitization in samples x(n), the samples being arranged in time frames, each comprising a number $N_s$ of samples. FIG. 7A shows an analogue electric signal (solid graph), e.g. representing an acoustic input signal, e.g. from a microphone, which is converted to a digital audio signal x(n) in an analogue-to-digital (AD) conversion process, where the analogue signal is sampled with a predefined sampling rate $f_s$, $f_s$ being e.g. in the range from 8 kHz to 48 kHz (adapted to the particular needs of the application) to provide digital samples x(n) at discrete points in time n, as indicated by the vertical lines extending from the time axis with solid dots at their endpoint 'coinciding' with the graph, and representing its digital sample value at the corresponding distinct point in time n. Each (audio) sample x(n) represents the value of the acoustic signal at time n by a predefined number $N_b$ of (quantization) bits, $N_b$ being e.g. in the range from 1 to 48 bit, e.g. 24 bits. Each audio sample is hence quantized using $N_b$ bits (resulting in $2^{Nb}$ different possible values of the audio sample).

In an analogue to digital (AD) process, a digital sample x(n) has a length in time of $1/f_s$, e.g. 50 μs, for $f_s$=20 kHz. A number of (audio) samples $N_s$ are e.g. arranged in a time frame, as schematically illustrated in the lower part of FIG. 1A, where the individual (here uniformly spaced) samples are grouped in time frames x(m) (comprising individual sample elements #1, 2, . . . , $N_s$)), where m is the frame number. As also illustrated in the lower part of FIG. 7A, the time frames may be arranged consecutively to be non-overlapping (time frames 1, 2, . . . , m, . . . , $N_M$), where m is a time frame index. Alternatively, the time frames may be overlapping (e.g. 50% or more, as illustrated in the lower part of FIG. 7A). In an embodiment, a time frame comprises 64 audio data samples. Other frame lengths may be used depending on the practical application. A time frame may e.g. have a duration of 3.2 ms (e.g. corresponding to 64 samples at a sampling rate of 20 kHz).

Figure 7B:
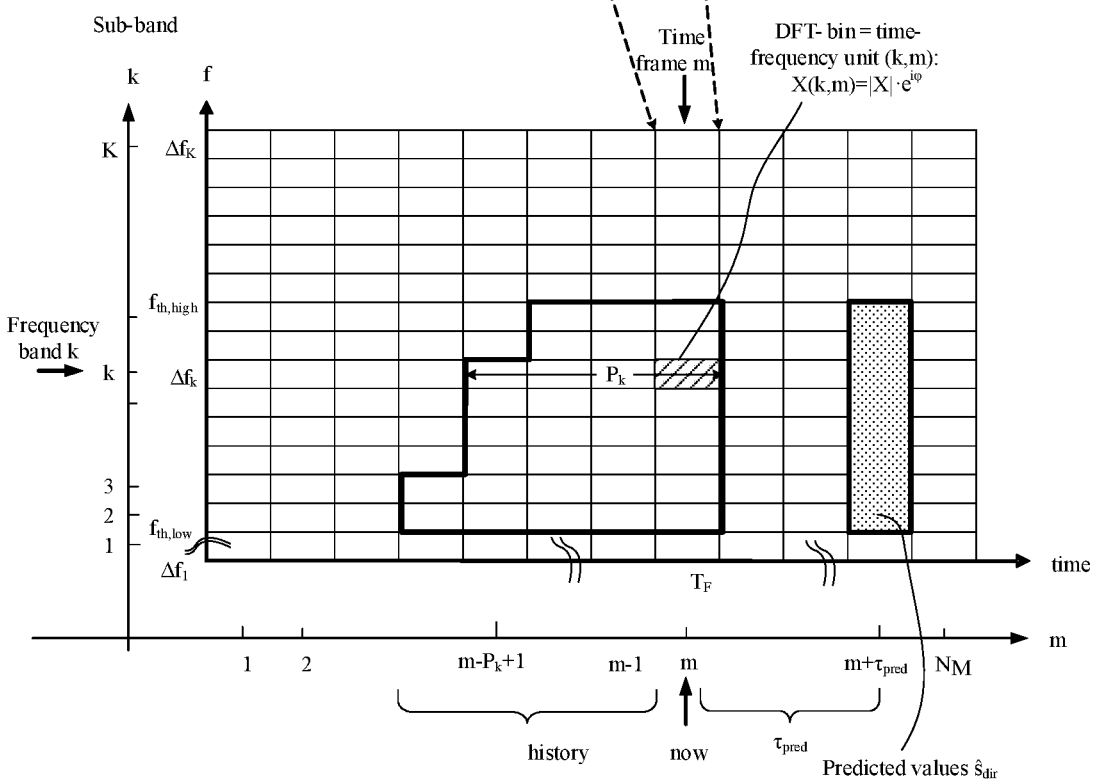

FIG. 7B schematically illustrates a time-frequency map (or frequency sub-band) representation of the time variant electric signal x(n) of FIG. 7A in relation to a prediction algorithm according to the present disclosure. The time-frequency representation $X_m(k)$ (k=1, . . . , K, where k is a frequency index) comprises an array or map of corresponding complex or real values of the signal in a particular time and frequency range. The time-frequency representation may e.g. be a result of a Fourier transformation converting the time variant input signal x(n) to a (time variant) signal X(k,m) in the time-frequency domain. In an embodiment, the Fourier transformation comprises a discrete Fourier transform algorithm (DFT), e.g. a short time Fourier transformation (STFT) algorithm. The frequency range considered by a typical hearing device (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 7B, the time-frequency representation X(k,m) of signal x(n) comprises complex values of magnitude and/or phase of the signal in a number of DFT-bins (or tiles) defined by indices (k,m), where k=1, . . . , K represents a number K of frequency values (cf. vertical k-axis in FIG. 7B) and m=1, . . . , $N_M$ represents a number $N_M$ of time frames (cf. horizontal m-axis in FIG. 7B). A time frame is defined by a specific time index m, and the corresponding K DFT-bins (cf. indication of Time frame m in FIG. 7B). A time frame m (or $X_m$) represents a frequency spectrum of signal x at time m. A DFT-bin or tile (k,m) comprising a (real) or complex value X(k,m) of the signal in question is illustrated in FIG. 7B by hatching of the corresponding field in the time-frequency map (cf. DFT-bin=time frequency unit (k,m):$X(k,m)=|X|\cdot e^{j\varphi}$ in FIG. 7B, where |X| represents a magnitude and φ represents a phase of the signal in that time-frequency unit. Each value of the frequency index k corresponds to a frequency range $\Delta f_k$, as indicated in FIG. 7B by the vertical frequency axis f. Each value of the time index m represents a time frame. The time $T_F$ spanned by consecutive time indices depend on the length of a time frame and the degree of overlap between neighbouring time frames (cf. horizontal time-axis in FIG. 7B).

A time frame of an electric signal may e.g. comprise a number $N_s$ of consecutive samples, e.g. 64, (written as vector $x_m$) of the digitized electric signal representing sound, m being a time index, cf. e.g. FIG. 7A. A time frame of an electric signal may, however, alternatively be defined to comprise a magnitude spectrum (written as vector $X_m$) of the electric signal at a given point in time (as e.g. provided by a Fourier transformation algorithm, e.g. an STFT (Short Time Fourier Transform)-algorithm, cf. e.g. schematic illustration of a TF-map in FIG. 7B. The time frame $x_m$ representing a number of time samples, and the time frame $X_m$ representing a magnitude spectrum (of the same time samples) of the electric signal are tied together by Fourier transformation, as e.g. given by the expression $X_m=\overline{F}\cdot x_m$, where $\overline{F}$ is a matrix representing the Fourier transform.

The electric input signal(s) representing sound may be provided as a number of frequency sub-band signals. The frequency sub-bands signals may e.g. be provided by an analysis filter bank, e.g. based on a number of band-pass filters, or on a Fourier transform algorithm as indicated above (e.g. by consecutively extracting respective magnitude spectra from the Fourier transformed data).

Figure 8B:
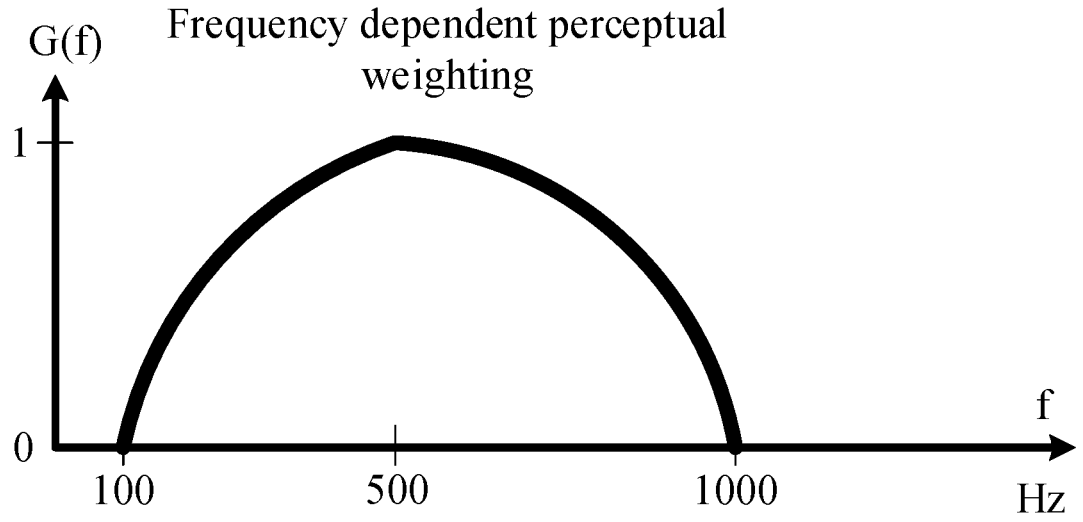

As indicated in FIG. 7B, a prediction algorithm according to the present disclosure may be provided on a frequency sub-band level (instead of on the full-band (time-domain) signal as described in connection with FIG. 3A-3E, etc.). Thereby a down-sampling of the update rate of the respective (frequency sub-band) prediction algorithms is provided (e.g. a factor of 20 or more). The bold 'stair-like' polygon in FIG. 7B enclosing a number of historic time-frequency units (DFT-bins) of the input signal (from time 'now' (index m) and $P_k$ time units backwards in time) indicate the part of the known input data that—for a given frequency band—are used to predict future values of the (directly propagated) signal $\hat{s}_{dir}$ at a prediction time $\tau_{pred}$ later index $m+\tau_{pred}$), cf. bold rectangle with dotted filling at time unit $m+\tau_{pred}$. The prediction algorithm may be executed in all frequency bands k=1, . . . , K, and may use the same number $P_k$ of historic values to predict the future value. But as indicated in the schematic illustration of FIG. 7B, the prediction algorithm may be executed only in selected frequency bands, e.g. frequency bands having the most importance for speech intelligibility, e.g. frequency bands above a low-frequency threshold frequency $f_{th,low}$ and below a high-frequency threshold frequency $f_{th,high}$. The high frequency threshold frequency $f_{th,high}$ may e.g. be 4 kHz (typically prediction is difficult at higher frequencies), or 3 kHz, or 2 kHz or smaller, e.g. 1 kHz. This is due in part to the origin of voice at frequencies above the high frequency threshold being mainly due to turbulent air streams in the mouth and throat region, which by nature is less predictable than voice at frequencies below the low-frequency threshold, which is mainly created by vibration of the vocal cords. The low-frequency threshold frequency $f_{th,low}$ may e.g. be larger than or equal to 100 Hz (typically human hearing perception is low below 100 Hz), or larger than or equal to 200 Hz or larger than or equal to 500 Hz (e.g. to take account of the fact that low frequency sound tend to escape through the vent or dome openings ('leakage', and thus do not disturb the signal at the eardrum significantly). Also, due to the frequency shaping of the directly propagated acoustic signal by the ear canal, low frequencies therein are attenuated and thus less important to compensate. The parameter $P_k$ indicating the number of past values of time-frequency units that are used to predict a future time-frequency unit may be different, e.g. decreasing with increasing frequency (as illustrated in FIG. 7B), e.g. to mimic an increasing time period of a fundamental frequency with decreasing frequencies. Likewise, the weighting factor $a_i$ applied to each previous value (time frequency unit) of a given frequency sub-band signal may be frequency dependent $a_i=a_i(k)=a_{i,k}$. Even the prediction time $\tau_{pred}$ (e.g. due to different values of the parameter $P_k$) may be frequency dependent ($\tau_{pred}=\tau_{pred}(k)=\tau_{pred,k}$). The individual prediction algorithms may be executed according to the present disclosure as discussed above for the full-band signal. Instead of operating on uniform frequency bands (the band width $\Delta f_k$ being independent of frequency index k) as shown in FIG. 7B, the prediction algorithms may operate on non-uniform frequency bands, e.g. having increasing width with increasing frequency (reflecting the logarithm nature of the human auditory system). FIG. 8A illustrates a number of exemplary parameterized perceptual masking functions $G_j(f)$, j=1, 2, 3. The masking functions vary between 0 and 1 for frequencies increasing from a lower frequency f1 to frequencies below a third frequency f3 having a maximum value of 1 at a frequency f2 there between. The masking functions $G_i(f)$ take on the value 0 for frequencies below f1 and above f3. The exemplary (theoretical) masking function $G_3(f)$ is equal to 1 for all frequencies in the range between f1 and f2 is equal to 0 outside this frequency range (in practice, a rounded off version of $G_3(f)$ would be more realistic). The exemplary masking functions $G_1(f)$, $G_2(f)$ each increase (monotonically) from 0 to 1 between f1 and f2 and decrease (monotonically) from 1 to 0 from f2 to f3, $G_1$ with linear course, $G_2$ with a non-linear course. The masking function $G_i(f)$ may take on any other course, e.g. piecewise linear or a combination of a linear and non-linear course. The minimum frequency f1 may e.g. be in the range from 50 Hz to 200 Hz. The maximum frequency 0 may e.g. be in the range from 800 Hz to 1200 Hz or to 1500 Hz. FIG. 8B shows an exemplary perceptual masking parameter functions G(f) as indicated in FIG. 8A by function $G_2(f)$, where f1=100 Hz, f2=500 Hz and f3=1000 Hz. The frequency dependent perceptual weighting function G(f) may e.g. be (chosen to be) fixed over time. The frequency dependent perceptual weighting function G(f) may e.g. be dependent on a particular hearing aid style (e.g. fixed for a given style), and/or a particular vent-size.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device configured to play sound into an ear canal of a user, the hearing device comprising at least one input transducer ($IT_q$) for picking up sound $s_q$ at said at least one input transducer from a sound field S around the hearing device and providing corresponding at least one electric input signal(s) $IN_q$ representing said sound $s_q$=1, . . . , Q, where Q≥1;

an analogue to digital converter for converting said at least one electric input signal(s) to a digitized signal represented by discrete samples $s_q(p)$, where p is a time sample index, a processor for processing said at least one electric input signal $s_q(p)$ to a processed signal;

an output transducer (OT) for converting an electric signal including said processed signal to an acoustic output signal;

a forward signal path of the hearing device being defined from an acoustic input to said at least one input transducer to an acoustic output of said output transducer having a forward signal propagation delay $\tau_{HI}$ of the hearing device, wherein the hearing device further comprises a compensation unit for at least partially cancelling directly propagated sound from said sound field S that is propagated to the ear canal via a direct acoustic propagation path, wherein the compensation unit is configured to predict said directly propagated sound and to play it in opposite phase of said directly propagated sound, and the compensation unit is configured to predict the discrete sample $s_q(p)$ in dependence of a delay $\tau_{comp}$ of the compensation unit.

2. A hearing device according to claim 1 wherein said compensation unit is configured to predict said directly propagated sound based on a linear or non-linear prediction algorithm or a combination of a linear and a non-linear prediction algorithm.

3. A hearing device according to claim 2 wherein said compensation unit is configured to predict said directly propagated sound based on a linear combination of a current and a number P−1 of past samples of the electric input signal, or a processed version thereof, using corresponding weights $a_i$, i=0, 1, . . . , P−1 or using a non-linear function f(.).

4. A hearing device according to claim 1 comprising a memory wherein parameters of relevance for the prediction of said directly propagated sound can be permanently and/or temporarily stored and accessed by said processor and/or by said compensation unit.

5. A hearing device according to claim 3 wherein said compensation unit is configured to determine said weights ad, i=0, 1, . . . , P−1 or said non-linear function f(.) in an off-line procedure.

6. A hearing device according to claim 3 wherein said compensation unit is configured to determine said weights $a_i$, i=0, 1, . . . , P−1 or said non-linear function f(.) during use of the hearing device.

7. A hearing device according to claim 3 wherein said compensation unit is configured to determine said weights $a_i$, i=0, 1, . . . , P−1 or said non-linear function f(.) using an optimization procedure involving a cost function.

8. A hearing device according to claim 6 wherein said weights $a_i$, i=0, 1, . . . , P−1 or said non-linear function f(.) are updated during use of the hearing device.

9. A hearing device according to claim 1 comprising a time to time-frequency conversion unit for providing a time-domain input signal in a frequency sub-band representation.

10. A hearing device according to claim 9 wherein said compensation unit is configured to minimize a prediction error, which is weighted as a function of time and/or frequency.

11. A hearing device according to claim 9 configured to execute the prediction algorithm only in selected frequency bands selected from frequency bands having the most importance for speech intelligibility, and frequency bands above a low-frequency threshold frequency $f_{th,low}$ and below a high-frequency threshold frequency $f_{th,high}$.

12. A hearing device according to claim 1 comprising an onset detector for identifying transients in the electric input signal and to provide an onset control signal in dependence thereof, wherein the compensation unit is configured to limit or override the currently predicted value of said directly propagated sound whenever the onset control signal indicates that a transient has been detected.

13. A hearing device according to claim 1 comprising at least two input transducers providing corresponding at least two electric input signals and a beamformer filtering unit for providing a spatially filtered signal based on said at least two electric input signals.

14. A hearing device according to claim 1 wherein the compensation unit is configured to predict the discrete samples $s_q(p)$ in dependence of a delay $\tau_{dir}$ of the direct acoustic propagation path.

15. A hearing device according to claim 1 wherein the compensation unit is configured to predict the discrete samples $s_q(p)$, which are $\tau_{pred}=\tau_{comp}-\tau_{dir}$ [seconds] in the future.

16. A hearing device according to claim 1 wherein the delay $\tau_{comp}$ of the compensation unit comprises the delay of the electric signal path from the input of the at least one input transducer to the output of the output transducer.

17. A hearing device according to claim 1 configured to include frequency-shaping of a transfer function representing said direct acoustic propagation path.

18. A hearing device according to claim 2 configured to control parameters of the prediction algorithm in dependence on detected own voice, such that the hearing device copes differently with external sounds compared to sound from the user's mouth.

19. A hearing device according to claim 1 being constituted by or comprising a hearing aid, or any other wearable earpiece.

20. A hearing device according to claim 1, wherein the delay $\tau_{dir}$ of the direct acoustic propagation path and/or the delay $\tau_{comp}$ of the compensation unit are/is frequency dependent.

21. A hearing device according to claim 1, wherein the directly propagated sound is predicted based on a neural network.

* * * * *